US006478411B2

(12) United States Patent
Kitahara

(10) Patent No.: US 6,478,411 B2
(45) Date of Patent: Nov. 12, 2002

(54) INK JET RECORDING HEAD AND METHOD OF MANUFACTURING THE SAME

(75) Inventor: Tsuyoshi Kitahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/923,797

(22) Filed: Aug. 8, 2001

(65) Prior Publication Data

US 2002/0047880 A1 Apr. 25, 2002

(30) Foreign Application Priority Data

| | | |
|---|---|---|
| Aug. 8, 2000 | (JP) | 2000-239896 |
| Apr. 5, 2001 | (JP) | 2001-106932 |
| Apr. 5, 2001 | (JP) | 2001-106933 |
| Aug. 2, 2001 | (JP) | 2001-234744 |

(51) Int. Cl.[7] ..... B41J 2/045
(52) U.S. Cl. ..... 347/70; 347/68
(58) Field of Search ..... 347/68–72, 54, 347/20

(56) References Cited

U.S. PATENT DOCUMENTS 5,818,482 A * 10/1998 Ohta et al. ..... 347/70

FOREIGN PATENT DOCUMENTS

| | | | |
|---|---|---|---|
| EP | 0 678 384 A1 | 10/1995 | |
| EP | 0694389 A2 * | 1/1996 | ..... 347/70 |
| EP | 1020292 A2 | 7/2000 | |
| JP | 10-181014 | 7/1998 | |

* cited by examiner

*Primary Examiner*—John Barlow
*Assistant Examiner*—An H. Do
(74) *Attorney, Agent, or Firm*—Sughrue Mion, PLLC

(57) ABSTRACT

A first surface of an elastic plate is bonded onto one surface of a channel forming substrate. A first face of a supporting base formed with a through hole therein is bonded onto a second surface of the elastic plate which is opposite to the first surface. A first face of a resin casing formed with an accommodation space therein is bonded onto a second face of the supporting base which is opposite to the first face of the supporting base. At least one vibrator unit including a fixation base, and piezoelectric vibrators arranged on a first face of the fixation base such that first ends of the piezoelectric vibrators are fixed thereon and opposite free ends overhang a second face of the fixation base. The vibrator unit is accommodated in the casing such that the piezoelectric vibrators extend through the through hole of the supporting base and the free ends thereof abut against the second surface of the elastic plate, and such that the second face of the fixation base is bonded onto the second face of the supporting base.

41 Claims, 19 Drawing Sheets

INK JET RECORDING HEAD AND METHOD OF MANUFACTURING THE SAME

BACKGROUND OF THE INVENTION

The present invention relates to an ink jet recording head to be suitably used for a printer or a plotter.

A related ink jet recording head comprises a vibrator unit bonding a piezoelectric vibrator group to the surface of a fixation base formed of stainless steel, a casing for accommodating the vibrator unit, and a channel unit bonded to the tip portion of the casing and provided with a pressure chamber and a nozzle orifice.

The casing is molded of a synthetic resin, for example, and is provided with a housing space for accommodating and fixing the vibrator unit therein. The housing space is provided every vibrator unit. In a recording head comprising a plurality of vibrator units, therefore, a bulkhead portion molded integrally with the casing is provided between the adjacent housing spaces. The vibrator unit is bonded to the bulkhead portion and is thereby accommodated and fixed into the housing space.

For example, as shown in FIG. 20, the back face of a fixation base 1 is bonded to a bulkhead portion 2 so that a pair of vibrator units 3 are accommodated and fixed into housing spaces 4. In such a fixing state, the tip end face of each of piezoelectric vibrators 5 is exposed to the outside of a casing 6 through an opening on the tip side of the housing space 4, and the tip end face is bonded to an island portion 7*a* of an elastic plate 7. The piezoelectric vibrator 5 is extended in the longitudinal direction of the vibrator depending on the supply of power to the piezoelectric vibrator 5 and the extension causes the elastic plate 7 to be deformed so that the volume of a pressure chamber 8 is changed. By the change in the volume of the pressure chamber 8, therefore, a pressure fluctuation is generated on an ink in the pressure chamber 8 and an ink drop is discharged from a nozzle orifice 9.

In the related recording head, thus, a plurality of housing spaces 4 are provided with the bulkhead portion 2 interposed therebetween and the vibrator unit 3 is accommodated and fixed every housing space 4. For this reason, when the number of the vibrator units 3 to be accommodated and fixed into one recording head is increased, the size of the casing 6 is to be increased correspondingly so that the size of the recording head is increased.

Moreover, since the vibrator unit 3 is bonded to the bulkhead portion 2, it is necessary to enhance the rigidity of the bulkhead portion 2. In order to obtain a requisite rigidity, it is necessary to increase the thickness of the bulkhead portion 2. Also in this respect, the size of the recording head is increased.

In a recent vibrator unit, particularly, the number of the piezoelectric vibrators provided in one vibrator unit tends to be increased. Therefore, a higher rigidity is required for the bulkhead portion. As a result, it is necessary to more increase the thickness of the bulkhead portion. Consequently, the size of the recording head is further increased.

Moreover, the casing 6 is generally formed of a synthetic resin. For this reason, in the case in which the recording head is put in a high humidity environment, the bulkhead portion 2 is swollen by moisture absorption as shown in FIG. 21. By the swelling, the piezoelectric vibrators 5 might be inclined toward the outside. If the piezoelectric vibrator 5 is inclined, a stress is applied to a bonding interface of the piezoelectric vibrator 5 and the island portion 7*a* so that the piezoelectric vibrator 5 is easily peeled from the island portion 7*a*. Moreover, since an unnatural stress is applied to the elastic plate 7, there is a possibility that a discharge characteristic might be adversely influenced.

SUMMARY OF THE INVENTION

The invention has been made in consideration of such circumstances and has a main object to provide an ink jet recording head which can be small-sized. Moreover, the invention has another object to provide an ink jet recording head capable of preventing drawbacks from being caused by the moisture absorption of a casing and ensuring workability and assembling properties and a method of manufacturing the ink jet recording head.

In order to achieve the above objects, according to the present invention, there is provided an ink jet recording head, comprising:

- a channel forming substrate, in which a channel which extends from a common ink reservoir to nozzle orifices via pressure chambers associated with the respective nozzle orifices;
- an elastic plate, a first surface thereof being bonded onto one surface of the channel forming substrate;
- a supporting base formed with at least one through hole therein, a first face thereof being bonded onto a second surface of the elastic plate which is opposite to the first surface of the elastic plate;
- a resin casing formed with an accommodation space therein, a first face thereof being bonded onto a second face of the supporting base which is opposite to the first face of the supporting base; and
- at least one vibrator unit, including a fixation base, and piezoelectric vibrators arranged on a first face of the fixation base such that first ends of the piezoelectric vibrators are fixed thereon and opposite free ends overhang a second face of the fixation base, the vibrator unit accommodated in the accommodation space of the casing such that the piezoelectric vibrators extend through the through hole of the supporting base and the free ends thereof abut against the second surface of the elastic plate, and such that the second face of the fixation base is bonded onto the second face of the supporting base.

In this configuration, since the fixation base of the vibrator unit is bonded onto the supporting base, the size of the recording head can be reduced.

Moreover, it is possible to eliminate the bond of the casing and the vibrator unit, and to more decrease the bonding area than that in the related configuration. Therefore, it is possible to reduce a mechanical stress received by the vibrator unit due to the moisture absorption of the casing. Consequently, it is possible to eliminate a drawback caused by the mechanical stress, for example, to prevent a fluctuation in the discharge characteristic and the peeling of the piezoelectric vibrator from the elastic plate.

Preferably, the supporting base is made of metal material.

Here, it is preferable that the supporting base is made of stainless steel.

Preferably, the fixation base is made of metal material.

Here, it is preferable that the supporting base is made of metal material identical with the metal material forming the fixation base.

In the above configurations, the supporting base and the fixation base can be formed of a member having a relatively high rigidity. Therefore, the rigidity of the recording head can be increased and the reaction force applied from the piezoelectric vibrator can be received sufficiently. Consequently, the discharge characteristic of the ink drop can be stabilized. Furthermore, a member having high dimensional precision is used for the supporting base. Therefore, it is also possible to prevent a positional shift of the piezoelectric vibrator and the channel unit after the bonding.

Preferably, at least one concave groove is formed on the second face of the supporting base in the vicinity of the through hole, to hold adhesive for bonding the fixation base.

In this configuration, the adhesive can be selectively injected between the supporting base and the fixation base.

Here, it is preferable that there is defined a first gap between the second face of the supporting base and the second face of the fixation base, into which the adhesive held in the concave groove enters.

Further, it is preferable that a dimension of the first gap is so determined as to establish a capillary attraction therein.

In the above configurations, the adhesive can be reliably prevented from spilling. Furthermore, it is possible to position the vibrator unit with very high positional precision while reliably causing the piezoelectric vibrator to abut on the elastic plate.

Besides, it is preferable that a plurality of concave grooves are formed on the fixation base.

Here, it is preferable that a width of the second face of the fixation base is wider than a width of an area on which the piezoelectric vibrators are arranged. The concave grooves are placed in the vicinity of both widthwise ends of the second face of the fixation base.

Besides, it is preferable that the concave groove is formed such that a first part thereof is situated outside of a bonding area onto which the fixation base is bonded. The adhesive is injected from the first part.

Here, it is preferable that the first part is directed to a thickness direction of the second face of the fixation base.

Alternatively, the first part may be directed to a widthwise direction of the second face of the fixation base.

Further, it is preferable that a width of the first part becomes wider as being away from the bonding area.

Preferably, a dimension of the through hole in a first direction in which the piezoelectric vibrators are arranged is wider than a width of the second face of the fixation base, so that both side ends of the through hole in the first direction is situated outside of an area for bonding the supporting base and the fixation base.

Preferably, side faces of the fixation base which are other than the first face and the second face are bonded onto an inner face of the accommodation space of the casing.

Here, it is preferable that there is defined a second gap between each side face of the fixation base and the inner face of the casing, to hold adhesive therein for bonding the fixation base and the casing.

Further, it is preferable that a dimension of the second gap is so determined as to establish a capillary attraction therein.

Besides, it is preferable that a guide passage is formed on the inner face of the casing such that a first end thereof opens at a second face of the casing which is opposite to the first face of the casing, and such that a second end thereof is placed at an area in which the side faces of the fixation base faces the inner face of the casing. Here, adhesive is injected from the first end of the guide passage to bond the fixation base onto the inner face of the casing.

In this configuration, the adhesive can be reliably injected between the inner face of the casing and the fixation base.

Here, it is preferable that a width of the guide passage becomes wider as closing to the first end thereof.

Preferably, a pair of vibrator units are accommodated in the casing while third faces of the fixation bases which are opposite to the respective first faces are faced with each other.

Preferably, an acoustic impedance of the fixation base is greater than that of the piezoelectric vibrator.

Here, it is preferable that a Young's modulus of the fixation base is greater than that of the piezoelectric vibrator.

Alternatively, it is preferable that a density of the fixation base is greater than that of the piezoelectric vibrator.

According to the present invention, there is also provided An ink jet recording head, comprising:

a channel unit including:

a channel forming substrate, in which a channel which extends from a common ink reservoir to nozzle orifices via pressure chambers associated with the respective nozzle orifices; and an elastic plate, a first surface thereof being bonded onto one surface of the channel forming substrate; and a pair of vibrator units, each including a fixation base, and piezoelectric vibrators arranged on a first face of the fixation base such that first ends of the piezoelectric vibrators are fixed thereon and opposite free ends overhang a second face of the fixation base, the vibrator units arranged such that the free ends of the piezoelectric vibrators abut against a second surface of the elastic plate which is opposite to the first surface of the elastic plate, and such that third faces of the fixation bases which are opposite to the respective first faces are faced with each other.

In this configuration, the resin bulkhead portion provided in the housing space of the related configuration can be eliminated. Therefore, it is possible to efficiently accommodate the vibrator units in the casing.

Preferably, the third faces are bonded with each other via an adhesive layer.

Here, it is preferable that the adhesive layer is placed so as to include a first area which is opposite to an area on which the first ends of the piezoelectric vibrators are fixed.

Here, it is preferable that a recessed portion is formed on the third face of the fixation base so as to open at a fourth face of the fixation base which is opposite to the second face of the fixation base.

Further, it is preferable that the fixation bases are integrated such that the respective recessed portions faces with each other.

Preferably, there is defined a first gap between the third faces of the fixation bases so as to become narrow at a first area which is opposite to an area on which the first ends of the piezoelectric vibrators are fixed.

Preferably, the recording head further comprises a resin casing formed with a space for accommodating the vibrator units therein, a first face thereof being bonded onto the second surface of the elastic plate.

Here, it is preferable that a guide face is formed on an inner face of the casing for guiding the fixation bases when the vibrator units are accommodated in the casing.

Further, it is preferable that both widthwise end portions of the fixation base is guided by the guide face.

Besides, the fixation base and the guide face are bonded with adhesive.

Here, it is preferable that the guide face and a portion of the fixation base facing the guide face are separated such an extent that the adhesive cannot enter a gap defined therebetween.

Here, it is preferable that a portion of the guide face which faces an outermost piezoelectric vibrator is notched such an extend that the adhesive cannot enter the notched portion.

Besides, it is preferable that the second face of the fixation base is bonded onto the casing.

Preferably, a coefficient of linear expansion of the fixation base is substantially identical with that of the channel unit.

Preferably, the fixation base is made of at least one of stainless steel, ceramics and piezoelectric material.

Preferably, the adhesive is epoxy based adhesive.

Since the epoxy based adhesive has a low viscosity, it can be caused to easily flow into the gap. Furthermore, the adhesive can be solidified after the positioning. Therefore, the alignment of the vibrator unit can be reliably carried out and yield can be enhanced. Furthermore, great bonding force can be obtained after the bonding.

According to the present invention, there is also provided a method of manufacturing an ink jet recording head, comprising the steps of:

providing a channel unit including: a channel forming substrate, in which a channel which extends from a common ink reservoir to nozzle orifices via pressure chambers associated with the respective nozzle orifices; and an elastic plate, a first surface thereof being bonded onto one surface of the channel forming substrate;

providing a resin casing formed with an accommodation space therein;

bonding a first face of the casing unit onto a second surface of the elastic plate which is opposite to the first surface;

providing a pair of vibrator units, each including a fixation base, and piezoelectric vibrators arranged on a first face of the fixation base such that first ends of the piezoelectric vibrators are fixed thereon and opposite free ends overhang a second face of the fixation base; and inserting the vibrator units into the accommodation space in the casing such that the free ends of the piezoelectric vibrators abut against a second surface of the elastic plate, and such that third faces of the fixation bases which are opposite to the respective first faces are faced with each other.

Preferably, the method further comprises the steps of: applying adhesive into the third faces of the fixation bases, before the inserting step; and solidifying the adhesive after the vibrator units are placed in the casing.

Alternatively, it is preferable that the method further comprises the steps of: forming a guide face on an inner face of the accommodation space in the casing, which is used to guide the fixation bases when the vibrator units are inserted into the accommodation space; applying adhesive between the fixation bases and the guide face; and solidifying the adhesive after the vibrator units are placed in the casing.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
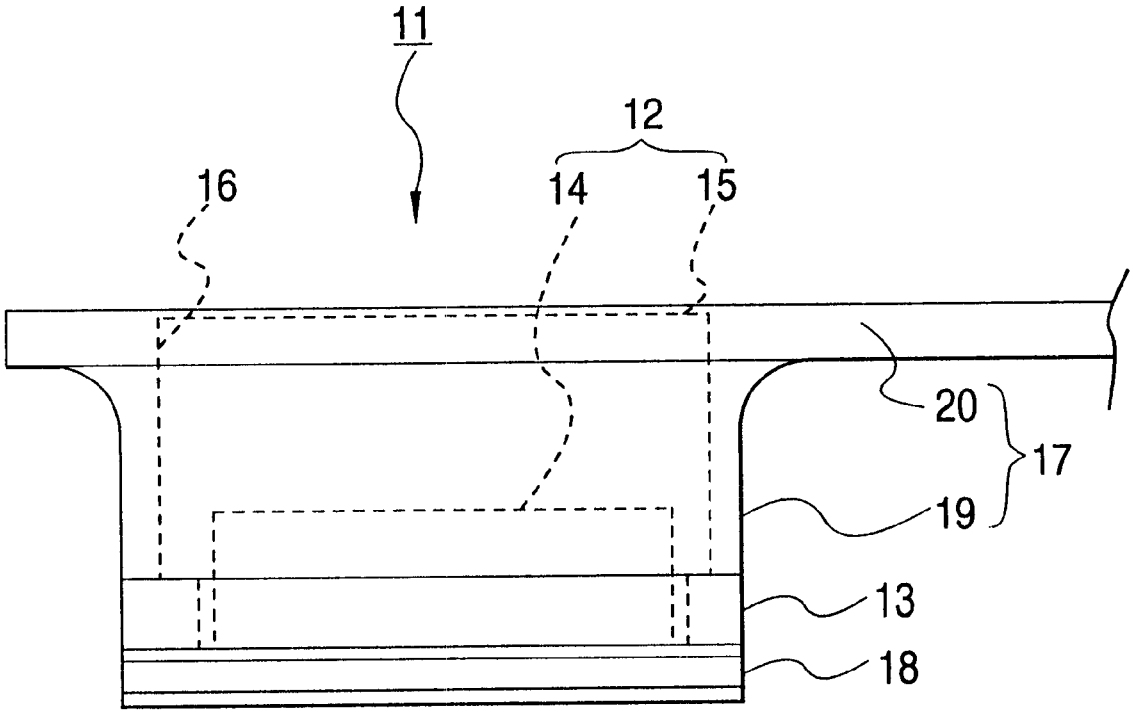
FIG. 1 is a view showing the appearance of an ink jet recording head.
Figure 3:
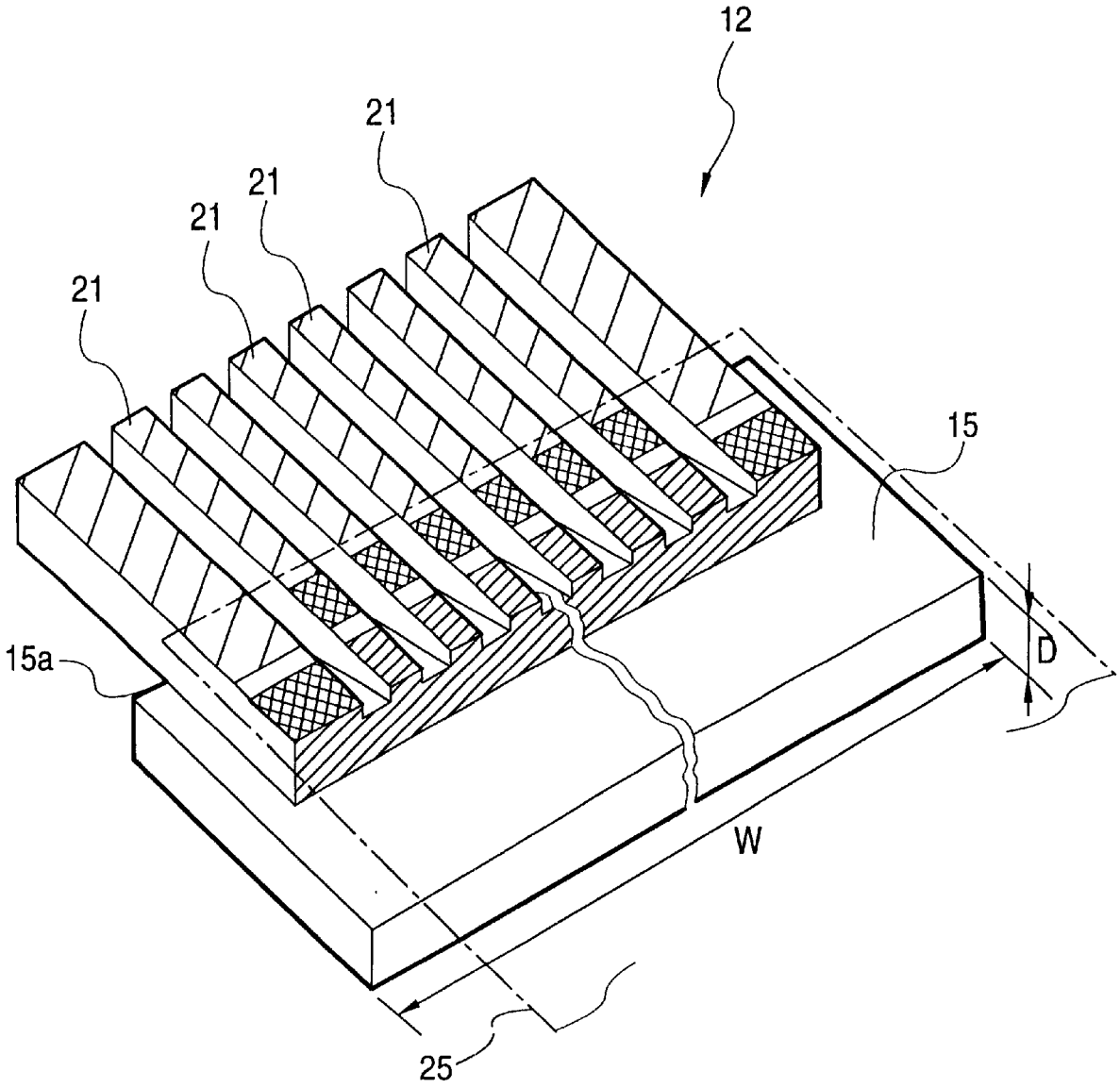
FIG. 3 is a perspective view showing a vibrator unit.
Figure 4:
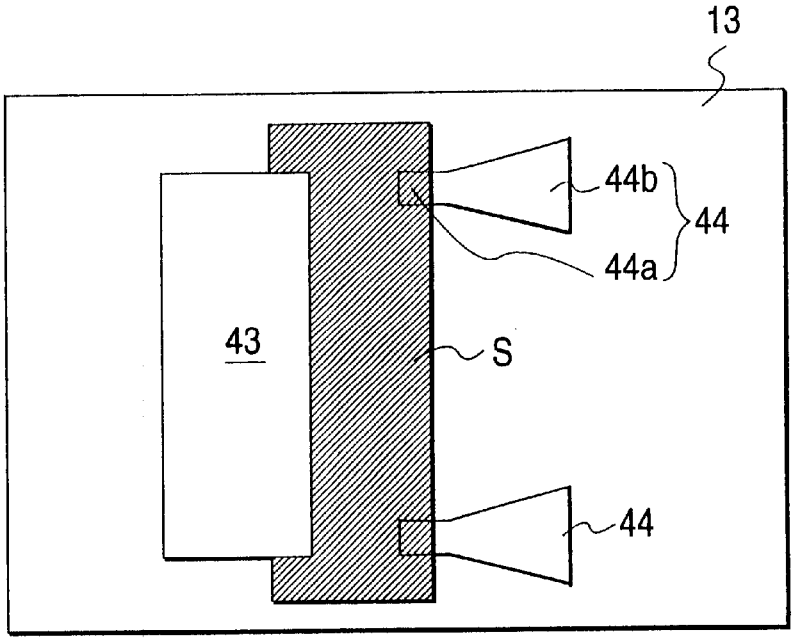
FIG. 4 is a view seen in a direction of an arrow A—A of FIG. 2.

Embodiments of the invention will be described below with reference to the drawings. FIG. 1 is a view showing the appearance of an ink jet recording head 11 (which will be hereinafter referred to as a recording head 11), FIG. 2 is a sectional view showing the recording head 11, FIG. 3 is a perspective view showing a vibrator unit 12, and FIG. 4 is a view seen in a direction of a 4—4 line in FIG. 2.

Figure 2:
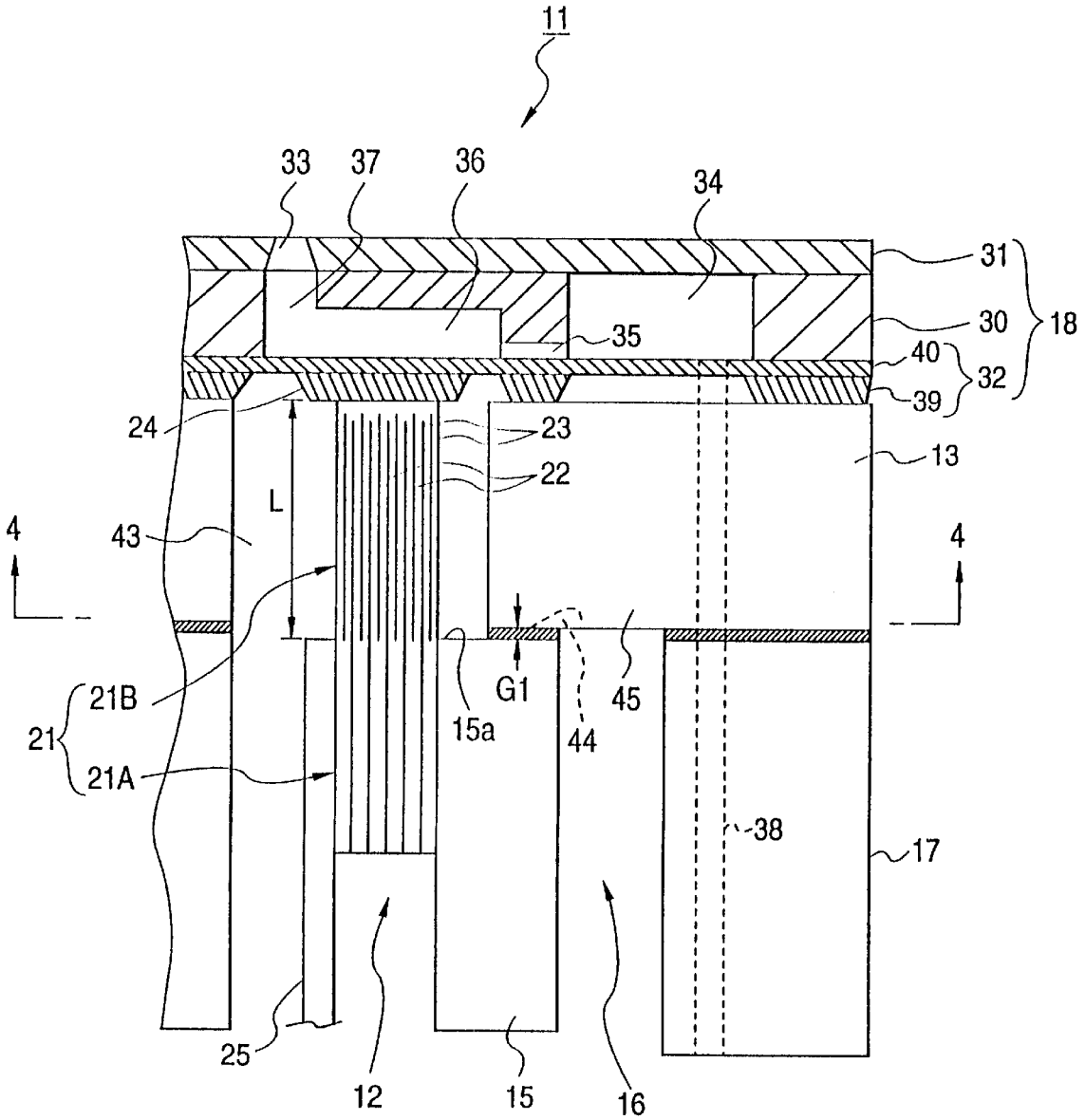
FIG. 2 is a sectional view showing an ink jet recording head according to a first embodiment of the invention.

In FIG. 2, for convenience, description will be given with the upper and lower sides set to front and rear end sides respectively. In FIG. 4, moreover, the description will be given with transverse and vertical directions set to longitudinal and lateral directions of a supporting base 13 respectively.

As shown in FIG. 1, the recording head 11 is constituted by a vibrator unit 12 having a piezoelectric vibrator group 14 and a fixation base 15 supporting the piezoelectric vibrator group 14, a casing 17 having a housing space 16 capable of accommodating a portion on the fixation base side in the vibrator unit 12, a supporting base 13 bonded to the front end face of the casing 17, and a channel unit 18 bonded to the surface of the supporting base 13 on the opposite side of the casing 17 and provided with a pressure chamber 36 and a nozzle orifice 33 (see FIG. 2).

The casing 17 has a box-shaped casing body 19 and a flange portion 20 extended from the base end of the casing body 19 toward the side, and is molded of a synthetic resin such as an epoxy resin.

First of all, the vibrator unit 12 will be described.

As shown in FIGS. 2 and 3, the piezoelectric vibrator group 14 is constituted by a plurality of saw-toothed piezoelectric vibrators 21. The piezoelectric vibrator 21 is formed like a needle having a very small width of approximately 50 to 100 $\mu$m, for example. The piezoelectric vibrator 21 is of a lamination type in which a piezoelectric member 22 and an internal electrode 23 are alternately provided and is set in a longitudinal vibration mode in which it can be extended in a longitudinal direction orthogonal to the direction of the lamination. In each of the piezoelectric vibrators 21, a base end portion 21A is bonded onto the fixation base 15 so that a free end portion 21B is protruded outward from a front end face 15*a* of the fixation base 15. More specifically, the piezoelectric vibrator 21 is supported onto the fixation base 15 in a cantilevered manner.

Moreover, the tip end face of the free end portion 21B in each of the piezoelectric vibrators 21 is bonded in such a state as to abut on an island portion 24 (which will be described below) to be a predetermined portion of the channel unit 18. Furthermore, a flexible cable 25 for supplying power to each of the piezoelectric vibrators 21 is electrically connected to the piezoelectric vibrator 21 on a surface to be the base end portion 21A of the piezoelectric vibrator 21 on the opposite side of the fixation base 15.

The fixation base 15 supporting each of the piezoelectric vibrators 21 is constituted by a plate-shaped member having such a rigidity as to receive reaction force applied from the piezoelectric vibrator 21. It is preferable that the fixation base 15 should be constituted by a metallic plate member having a thickness D which is approximately a half to double of the length of a pressure chamber 36. In the embodiment, the length of the pressure chamber 36 is approximately 1 mm. Therefore, a metal plate having a thickness of approximately 0.5 mm to 2 mm is used. It is preferable that stainless steel having a thickness of 1 mm adapted to the length of the pressure chamber 36 should be used. Moreover, a width W of the fixation base 15 (a length in a direction of arrangement of the piezoelectric vibrators 21) is set to be greater than a thickness D of the fixation base 15 and to be slightly greater than a width of the piezoelectric vibrator group 14 as shown in FIG. 3.

Next, the channel unit 18 will be described. As shown in FIG. 2, the channel unit 18 is constituted by providing and laminating a nozzle plate 31 on one of the surfaces of a channel forming substrate 30 and an elastic plate 32 on the other surface opposite to the nozzle plate 31 with the channel forming substrate 30 interposed therebetween and integrating them through bonding.

The nozzle plate 31 is a thin plate formed of stainless steel having a plurality of nozzle orifices 33 linearly arranged at a pitch corresponding to a dot formation density. In the embodiment, for example, 96 nozzle orifices 33 are provided at a pitch of 180 dpi to form nozzle rows.

The channel forming substrate 30 is a plate-shaped member provided with an ink passage sequentially passing through a common ink reservoir 34, an ink supply port 35, the pressure chamber 36 and a nozzle communicating port 37. More specifically, the channel forming substrate 30 forms a plurality of spaces to be the nozzle communicating port 37, the pressure chamber 36 and the ink supply port 35 corresponding to the nozzle orifices 33, and is a plate-shaped member forming a space to be the common ink reservoir 34. The channel forming substrate 30 according to the embodiment is fabricated by etching a silicon wafer.

The pressure chamber 36 is a slender chamber in a direction orthogonal to the direction of the arrangement of the nozzle orifices 33 (that is, the direction of the nozzle line) and is constituted by a flat concave chamber partitioned by a weir portion. The weir portion is formed from an outlet of the common ink reservoir 34 to an inlet of the nozzle communicating port 37 and the ink supply port 35 is formed in the form of a bottleneck portion having a small passage width through the weir portion.

The nozzle communicating port 37 is a portion for causing the pressure chamber 36 to communicate with the nozzle orifice 33. The nozzle communicating port 37 is formed on one of the ends of the pressure chamber 36, that is, in a position which is the most distant from the common ink reservoir 34 in the pressure chamber 36.

The common ink reservoir 34 is an ink storage chamber for supplying an ink stored in an ink cartridge (not shown) to each of the pressure chambers 36, and communicates with the other end of the corresponding pressure chamber 36 through the ink supply port 35. Moreover, an ink supply pipe communicates with the common ink reservoir 34. The ink supplied from the ink cartridge is introduced into the common ink reservoir 34 through the ink supply pipe 38.

The elastic plate 32 is a composite plate member having a double structure in which an elastic film 40 formed of a resin such as PPS (polyphenylene sulfide) is laminated on a support plate 39 formed of metal such as stainless steel.

The elastic plate 32 seals the opening face of a space to be the pressure chamber 36, thereby constituting a part of the pressure chamber 36. More specifically, the elastic plate 32 serves as a diaphragm portion. Moreover, since the elastic plate 32 seals the opening face of a space to be the common ink reservoir 34, the same portion also serves as a compliance portion.

A portion to serve as the diaphragm portion, that is, a portion corresponding to the pressure chamber 36 is subjected to etching and the support plate 39 in the same portion is annularly removed leaving the elastic film 40 so that the island portion 24 for bonding the tip end face of the piezoelectric vibrator 21 is provided. The island portion 24 has the shape of a slender block in a direction orthogonal to the direction of the arrangement of the nozzle orifice 33 in the same manner as the planar shape of the pressure chamber 36. Moreover, a portion to serve as the compliance portion, that is, a portion corresponding to the common ink reservoir 34 is also etched and the support plate 39 is removed to cause only the elastic film 40 to remain.

In the elastic plate 32, when the piezoelectric vibrator 21 is extended in the longitudinal direction of the vibrator, the island portion 24 is pressed toward the nozzle plate 31 side and the elastic film 40 provided around the island portion is deformed so that the pressure chamber 36 is contracted. Moreover, when the piezoelectric vibrator 21 is contracted in the longitudinal direction of the vibrator, the pressure chamber 36 is expanded by the elasticity of the elastic film 40. When the expansion and contraction of the pressure chamber 36 is controlled, an ink pressure in the pressure chamber 36 fluctuates. Therefore, an ink drop is discharged from the nozzle orifice 33.

Next, the supporting base 13 will be described. As shown in FIGS. 2 and 4, the supporting base 13 is a rectangular plate-shaped member provided with a through hole 43 in a direction of a thickness of the plate through which a free end portion 21B of each piezoelectric vibrator 21 can be inserted, and with a concave groove 44 in the vicinity of the through hole 43. The supporting base 13 is bonded between the casing 17 and the channel unit 18 in a lamination state.

A metal material and ceramics are suitably used for a material constituting the supporting base 13. In the embodiment, stainless steel which is the same metal material as that of the fixation base 15 is used. Moreover, the thickness of the supporting base 13 is set to be slightly smaller than a length L of the free end portion, 21B of the piezoelectric vibrator 21. In the state of the arrangement of the vibrator unit 12, consequently, a gap G1 to be such a spacing as to hold an adhesive through capillary force is formed between the surface of the supporting base 13 and the front end face 15*a* of the fixation base 15.

Furthermore, the surface of the supporting base 13 on the elastic plate 32 side and the surface on the casing 17 side are finished to be smooth surfaces having high precision through surfacing such as lapping or polishing. In the embodiment, the surfaces are finished to be very smooth surfaces having approximately Ra=3 ($\mu$m).

The through hole 43 is formed as a rectangular opening through punching. The through hole 43 according to the embodiment is constituted as an opening which is a size larger than the external shape of the piezoelectric vibrator group 14.

The concave groove 44 serves as an adhesive reservoir for holding an adhesive to bond the fixation base 15 of the vibrator unit 12 to the supporting base 13. Moreover, the concave groove 44 also serves as an injecting port for the adhesive when the fixation base 15 is to be bonded to the supporting base 13.

The concave groove 44 is provided on the surface of the supporting base 13 on the opposite side of the elastic plate 32 such that a portion 44*a* thereof is positioned in a bonding region S (a hatched region in FIG. 4) in which the front end face 15*a* of the fixation base 15 and a residual portion 44*b* is positioned on the outside of the bonding region S. Moreover, the concave groove 44 has such a width that a portion 44*a* on the bonding region S side is narrower and a portion 44*b* provided on the outside of the bonding region S becomes gradually wider when it goes away from the bonding region S. Furthermore, the concave groove 44 has such a depth that the portion 44*a* on the bonding region S side is shallower and the portion 44*b* provided on the outside of the bonding region S becomes gradually deeper when it goes away from the bonding region S. The portion 44*b* provided on the outside of the bonding region S is used as the injecting port for the adhesive (which will be hereinafter referred to as an adhesive injection port 44*b*) and the portion 44*a* on the bonding region S side is used as a guide portion for the adhesive (which will be hereinafter referred to as an adhesive guide portion 44*a*).

Moreover, a plurality of concave grooves 44 are provided for one fixation base 15. In the embodiment, one concave groove 44 is provided in the vicinity of each of both ends in the lateral direction of the fixation base 15, that is, two concave grooves 44 are provided in total. The reason why a plurality of concave grooves 44 are thus provided is that the adhesive is to be reliably introduced into the gap G1 during the bond of the supporting base 13 to the fixation base 15.

In the embodiment, moreover, the concave groove 44 is extended in a direction of a thickness D of the fixation base 15 (corresponding to the transverse direction in FIG. 4) through a border line (an edge portion) in the bonding region S in the transverse direction of the fixation base 15. With such a structure, the width of the supporting base 13 can be reduced, thereby contributing to a reduction in the size of the recording head 11.

Next, the casing 17 will be described. The casing 17 is a block-shaped member including the accommodating space 16 having a front and a rear end opened and is formed of a synthetic resin, more specifically, an epoxy resin. The housing space 16 is fabricated to have such a size as to accommodate a portion of the vibrator unit 12 on the fixation base side.

In the embodiment, the housing space 16 is constituted by a rectangular opening which is a size larger than the through hole 43. More specifically, a length of an opening edge on the shorter side is set to be approximately a double of an opening edge on the shorter side of the through hole 43 and a length of an opening edge on the longer side is set to be slightly greater than the width W of the fixation base 15.

The housing space 16 is preferably provided as a space capable of accommodating the portion of the vibrator unit 12 on the fixation base side and is not restricted to the illustrated shape.

The casing 17 is bonded with an adhesive in such a state that the front end face abuts on the surface of the supporting base 13. In the state of abutment, the through hole 43 of the supporting base 13 communicates with the housing space 16. Consequently, a housing chamber for accommodating and fixing the vibrator unit 12 therein is formed.

In the housing chamber, one of internal walls on the longer side of the through hole 43 and one of internal walls on the longer side of the housing space 16 are made flush with each other. Therefore, the other opposite internal wall of the housing space 16 is positioned inwardly (on the right side in FIG. 2) from the other opposite internal wall of the through hole 43. Consequently, a portion in the vicinity of the through hole of the supporting base 13 which is protruded from the internal wall of the housing space 16 is a protruded step portion 45.

The vibrator unit 12 is bonded to the protruded step portion 45. More specifically, the bonding region S is positioned on the surface at the casing side in the protruded step portion 45. Accordingly, the vibrator 12 is provided such that the front end face 15*a* of the fixation base 15 is closely opposed to the surface of the protruded step portion 45, and is bonded with the adhesive introduced into the gap G1 in such a state of arrangement.

In the recording head 11 having the structure described above, the members 13, 17 and 18 are bonded through the supporting base 13 provided between the channel unit 18 and the casing 17, and furthermore, the front end face 15*a* of the fixation base 15 in the vibrator unit 12 is bonded to the supporting base 13. Consequently, the supporting base 13 can be formed of a material having higher dimensional precision than that of the resin constituting the casing 17, for example, a metal material. Since the metal material can also be processed easily, the precision of the surface of the supporting base 13 can be enhanced. Consequently, the vibrator unit 12 can be assembled with high positional precision.

Moreover, the supporting base 13 and the fixation base 15 are formed of the same stainless steel. Therefore, coefficients of linear expansion of the supporting base 13 and the fixation base 15 can be adjusted to each other. Since the coefficient of linear expansion of the stainless steel is close to that of each member constituting the channel unit 18, deformation is caused by a change in a temperature with difficulty. Consequently, a shift of the piezoelectric vibrator 21 and the island portion 24 of the elastic plate 32 can be prevented after the bonding. The metallic steel such as stainless steel is not swollen with a high humidity. Also in this respect, the vibrator unit 12 can be assembled with high positional precision.

Moreover, since the fixation base 15 is bonded to the supporting base 13. Differently from the related structure in which bonding to a bulkhead portion is carried out, therefore, the bonding of the casing 17 and the vibrator unit 3 can be eliminated or the contact area can be more reduced than that in the related configuration. For this reason, the influence of the deformation with the moisture absorption of the casing 17 is extremely small. Consequently, it is possible to prevent drawbacks such as the inclination of the piezoelectric vibrator 21 from being caused by the moisture absorption of the casing 17. As a result, it is possible to enhance connecting reliability between the piezoelectric vibrator 21 and the elastic plate 32 and to prevent the piezoelectric vibrator 21 from being separated from the island portion 24. Furthermore, it is also possible to stabilize the discharge characteristic of ink drops.

Moreover, the reaction force applied when the piezoelectric vibrator 21 presses the island portion 24 acts on the supporting base 13 through the bonding region S. Since the stainless steel constituting the supporting base 13 has a higher rigidity than that of the resin constituting the casing 17, the reaction force can be received by the supporting base 13 and the piezoelectric vibrator 21 can be normally extended. As a result, the discharge of the ink drop can be stabilized. Furthermore, a Young's modulus of the stainless steel is approximately ten times as high as that of the resin constituting the casing 17. Therefore, even if the number of the piezoelectric vibrators 21 constituting the vibrator unit 12 is increased, the reaction force applied from the piezoelectric vibrator 21 can be received sufficiently and the discharge of the ink drop can be stabilized.

Next, the process for manufacturing the recording head 11 will be described. The recording head 11 having the structure described above is generally assembled in the following order. First of all, the channel unit 18 comprising the nozzle plate 31, the channel forming substrate 30 and the elastic plate 32 is laminated and integrated. Next, a portion to serve as the compliance portion of the elastic plate 32, that is, a portion corresponding to the common ink reservoir 34 and the stainless steel in the annular portion provided around the island 24 are removed by etching, thereby causing only the elastic film 40 to remain. Then, the supporting base 13 finished with good face precision is laminated and bonded onto the surface at the elastic plate 32 side of the channel unit 18. At this time, the supporting base 13 is bonded such that the concave groove 44 is positioned on a surface opposite to the elastic plate 32 side.

When the supporting base 13 is bonded, the vibrator unit 12 fabricated separately is bonded onto the supporting base 13. More specifically, the vibrator unit 12 is held by using a jig and the free ends 21B of the piezoelectric vibrators 21 are inserted in the through hole 43. In such a state that the tip end face of the free end portion 21B is caused to abut on the island portion 24 of the elastic plate 32, the position of the vibrator unit 12 is fixed. In the state of the arrangement, the adhesive guide portion 44*a* of the concave groove 44 is covered with the front end face 15*a* of the fixation base 15.

Since the thickness of the supporting base 13 is slightly smaller than the length L of the free end portion 21B, the gap G1 is formed between the surface of the supporting base 13 and the front end face 15*a* of the fixation base 15, that is, in the bonding region S in the state of the abutment of the island portion 24 and the free end portion 21B. The gap G1 is set to such a width that a fluid adhesive can be moved by capillary force, for example, approximately 50 to 300 $\mu$m. Since the gap G1 is provided, the piezoelectric vibrator 21 can abut on the island portion 24 in an optimum state, and furthermore, the vibrator unit 12 can be positioned with very high precision.

When the vibrator unit 12 is positioned, the adhesive is introduced into the gap G1 between the surface of the supporting base 13 and the front end face 15*a* of the fixation base 15, thereby bonding and fixing the fixation base 15 to the supporting base 13. More specifically, a nozzle in an adhesive injecting apparatus is caused to face the adhesive injection port 44*b* of the concave groove 44 and the adhesive is injected therein. For the adhesive, an adhesive having a low viscosity, for example, an epoxy based adhesive is suitably used.

Since the adhesive is injected from the adhesive injection port 44*b*, the injecting work can be carried out easily. Moreover, since the width of the groove of the adhesive injection port 44*b* is increased apart from the bonding region S, the nozzle of the adhesive injecting apparatus can be easily caused to face the adhesive injection port 44*b* and the injected adhesive spills out of the concave groove 44 with difficulty. Furthermore, as the adhesive injection port 44*b* goes away from the bonding region S, the depth thereof is increased so that the volume is increased. Therefore, a sufficient amount of the adhesive can be held in the concave groove 44 in order to fill in the gap G1.

When the concave groove 44 is filled with the adhesive injected from the adhesive injection port 44*b*, the adhesive is bulged like a convex by surface tension thereof. When the adhesive bulged in the adhesive guide portion 44*a* comes in contact with the front end face 15*a* of the fixation base 15, the adhesive flows into the gap G1 by the capillary force to fill in the bonding region S. By utilizing the capillary force, thus, the adhesive injected into the concave groove 44 is guided into the gap G1. Therefore, the adhesive can be reliably injected into the gap G1.

At this time, moreover, the adhesive is held in the gap G1 and the concave groove 44 by the surface tension thereof. Consequently, it is possible to prevent the adhesive from flowing into the through hole 43 for accommodating the piezoelectric vibrator group 14 or the adhesive from sticking to other portions. Accordingly, it is possible to eliminate the drawbacks that the actuation of the piezoelectric vibrator 21 is blocked by the extra adhesive.

If the gap G1 is filled with the adhesive, the adhesive in the gap G1 is solidified to bond and fix the fixation base 15 of the vibrator unit 12 to the supporting base 13. As described above, the vibrator unit 12 is positioned with high precision, it is possible to maintain the high positional precision of the vibrator unit 12 also after the bonding.

In the embodiment, moreover, the epoxy based adhesive is used. By raising an environmental temperature during the bonding, therefore, the solidification of the adhesive can be promoted so that the bonding can be carried out in a short time. Furthermore, the fixation base 15 and the supporting base 13 are formed of the same metal material, that is, stainless steel. Therefore, the adhesive can be selected easily and can also be bonded firmly.

While the step of forming the gap G1 between the supporting base 13 and the fixation base 15 and then injecting the adhesive in the gap G1 has been described in the embodiment, this step is not restricted.

For example, it is also possible to inject the adhesive into the concave groove 44 until it is bulged like a convex from the surface of the supporting base 13 by the surface tension, and to then accommodate the vibrator unit 12 in the housing space 16 to cause the surface of the supporting base 13 to extremely approach to the front end face 15*a* of the fixation base 15, thereby causing the adhesive to flow.

In this case, the surface of the supporting base 13 is caused to extremely approach to the front end face 15*a* of the fixation base 15 so that the adhesive comes in contact with the front end face 15*a* of the fixation base 15. The adhesive in contact flows into the gap G1 between the surface of the supporting base 13 and the front end face 15*a* of the fixation base 15 through a capillary action to fill in the bonding region S. Also in this casing, the adhesive is held in the concave groove 44. Therefore, the bonding can be carried out reliably without a shortage of the adhesive and the adhesive can be prevented from sticking to an undesired place.

In the embodiment, thus, the front end face 15*a* of the fixation base 15 is bonded and fixed to the surface of the supporting base 13 with the adhesive injected into the concave groove 44. Therefore, the bonding can be carried out easily and reliably also in a portion between the fixation base 15 and the supporting base 13 in which it is hard to directly inject the adhesive.

Next, modified examples of the first embodiment will be described.

Figure 5:
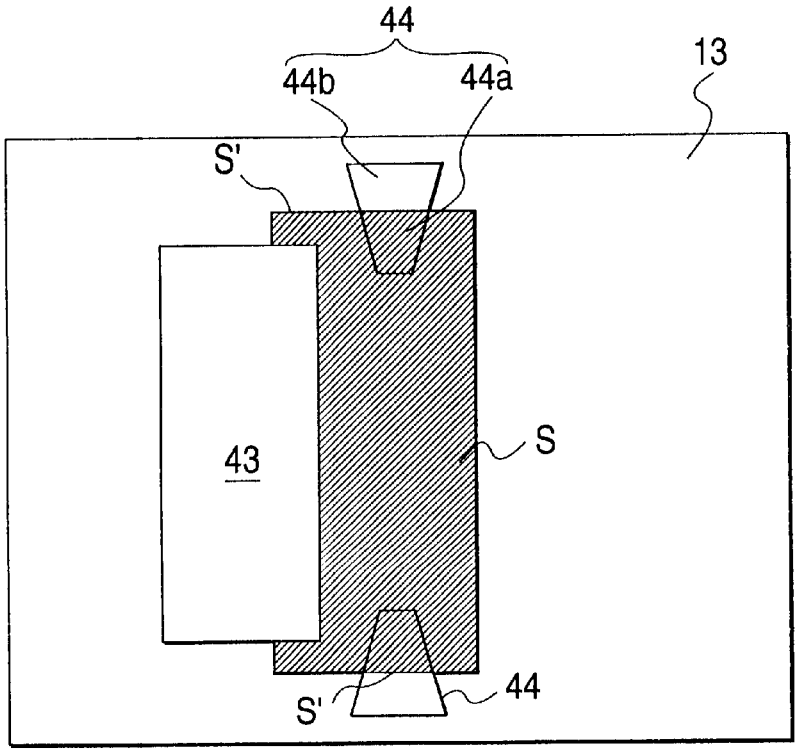
FIG. 5 is a view illustrating a first modified example of the first embodiment.

According to a first modified example shown in FIG. 5, the arrangement of a concave groove 44 is different from that of the first embodiment. More specifically, the concave groove 44 according to the first modified example is extended in the width direction (corresponding to the vertical direction in FIG. 5) of a fixation base 15 through a border line (an edge portion S') in the thickness direction of the fixation base in a bonding region S.

Moreover, the concave groove 44 has such a shape that a volume is sequentially increased when it goes away from the bonding region S (gap G1) toward the outside in the width direction of the fixation base 15. In the embodiment, the concave groove 44 has a trapezoidal plane shape, for example, and has a depth increased gradually when it goes away from the bonding region S toward the outside in the width direction.

Also in a structure of the first modified example, an adhesive is injected into the concave groove 44 and is held by surface tension. For this reason, the extra adhesive does not spill into a through hole 43. Moreover, the concave groove 44 has such a shape that a volume is sequentially increased when it goes away from the bonding region S. Therefore, the extra adhesive can be held in the concave groove 44 and the adhesive can be prevented from sticking onto other portions.

Accordingly, the advantageous effects similar to those of the first embodiment can be attained in this example.

Figure 6:
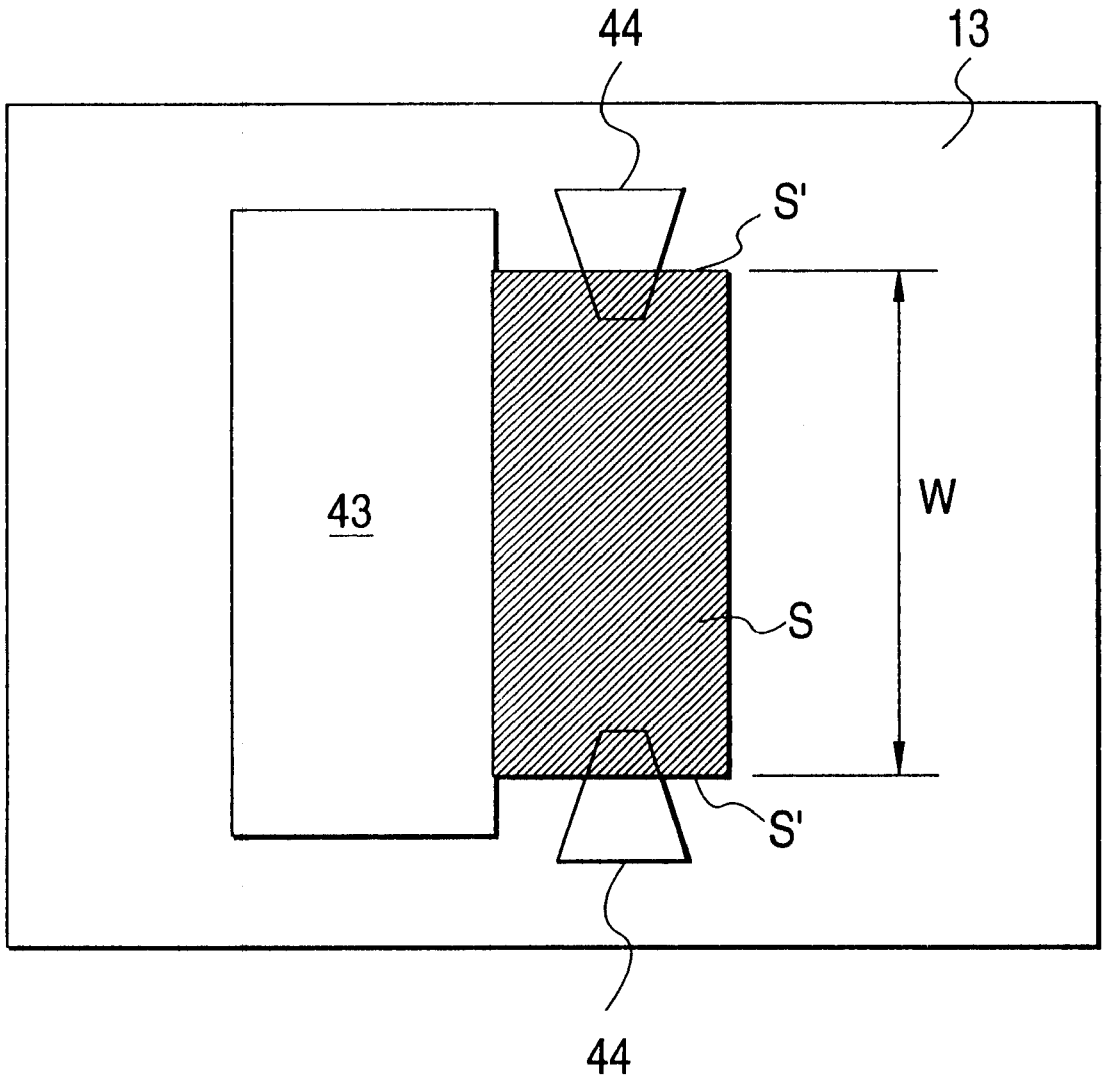
FIG. 6 is a view illustrating a second modified example of the first embodiment.

According to a second modified example shown in FIG. 6, relationship between the sizes of the through hole and the bonding region S is different from that of the first modified example. The second modified example is characterized in that a dimension in the width direction of the through hole 43 (corresponding to the direction, of arrangement of a vibrator) is set to be greater than a width W of the fixation base 15 and both ends in the width direction of the through hole 43 are positioned on the outside of the bonding region S in which a front end face 15*a* of the fixation base 15 is bonded to a supporting base 13.

The concave groove 44 according to the second modified example has such a shape that a volume is sequentially increased when it goes away from the bonding region S in the same manner as in the first modified example. For example, the concave groove 44 has such a trapezoidal plane shape that a width is gradually increased when it goes away from the bonding region S and has such a depth as to be increased gradually when it goes away from the bonding region S.

Also in the second modified example, the advantageous effects as same as those in the first embodiment and the first modified example can be obtained. In the second modified example, furthermore, the bonding region S of the front end face 15*a* of the fixation base 15 and the surface of the supporting base 13 is provided to keep away from the corner portion of the through hole 43. Consequently, the adhesive in the bonding region S is held in a gap G1 by surface tension thereof, and it is possible to reliably eliminate such a drawback that the adhesive goes around the corner portion of the through hole 43.

Figure 7:
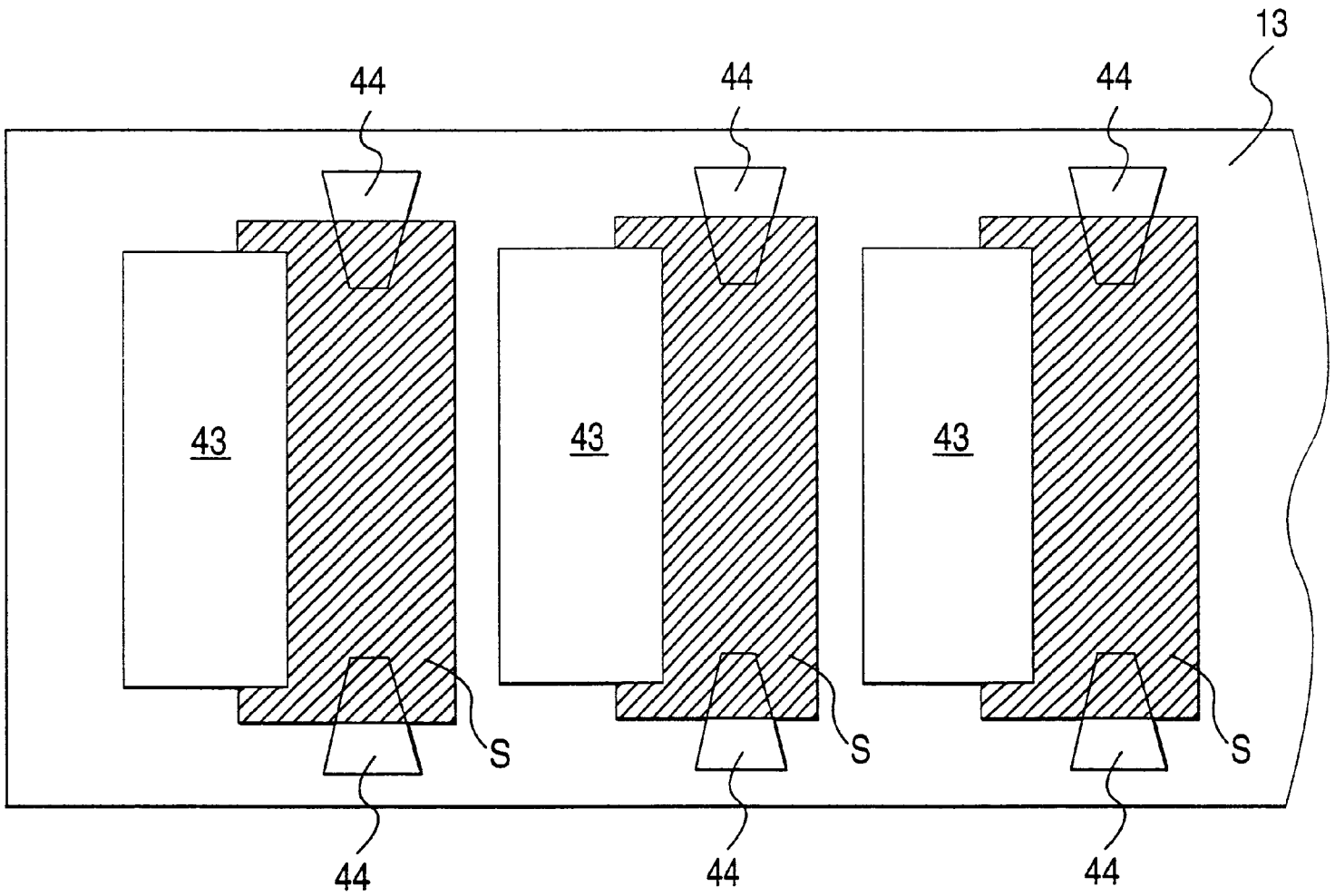
FIG. 7 is a view illustrating a third modified example of the first embodiment.

A third modified example shown in FIG. 7 is characterized in that a plurality of through holes 43 are provided in the longitudinal direction of a supporting base 13 and a plurality of vibrator units 12 are bonded in the longitudinal direction of the supporting base 13.

Also in the third modified example, the advantageous effects as same as those in the first embodiment and the first modified example can be obtained. In the third modified example, furthermore, the vibrator units 12 can be fixed with high positional precision in a recording head 11 including the vibrator units 12. Moreover, a front end face 15*a* of a fixation base 15 is bonded to the surface of the supporting base 13. Therefore, a bulkhead portion provided in the related recording head can be eliminated. Consequently, the vibrator units 12 can be provided closer to each other than those in the related configuration and the size of the recording head 11 can be reduced. Moreover, a space between adjacent nozzles can be more reduced than that in the related configuration.

While one concave groove 44 is provided on each of both ends in the width direction of the fixation base 15, that is, two concave grooves 44 are provided in total in the first embodiment and the modified examples thereof, the number of the concave grooves 44 is not restricted to two. For example, one concave groove 44 may be provided on almost a center in the width direction of the fixation base or three or more concave grooves 44 may be provided.

Next, a second embodiment will be described. A recording head according to the second embodiment is different from the first embodiment in that the side face of a fixation base is bonded to the inner wall face of a housing space. In the description of the second embodiment, the same members as those in the first embodiment have the same reference numerals and their description will be omitted.

Figure 8A:
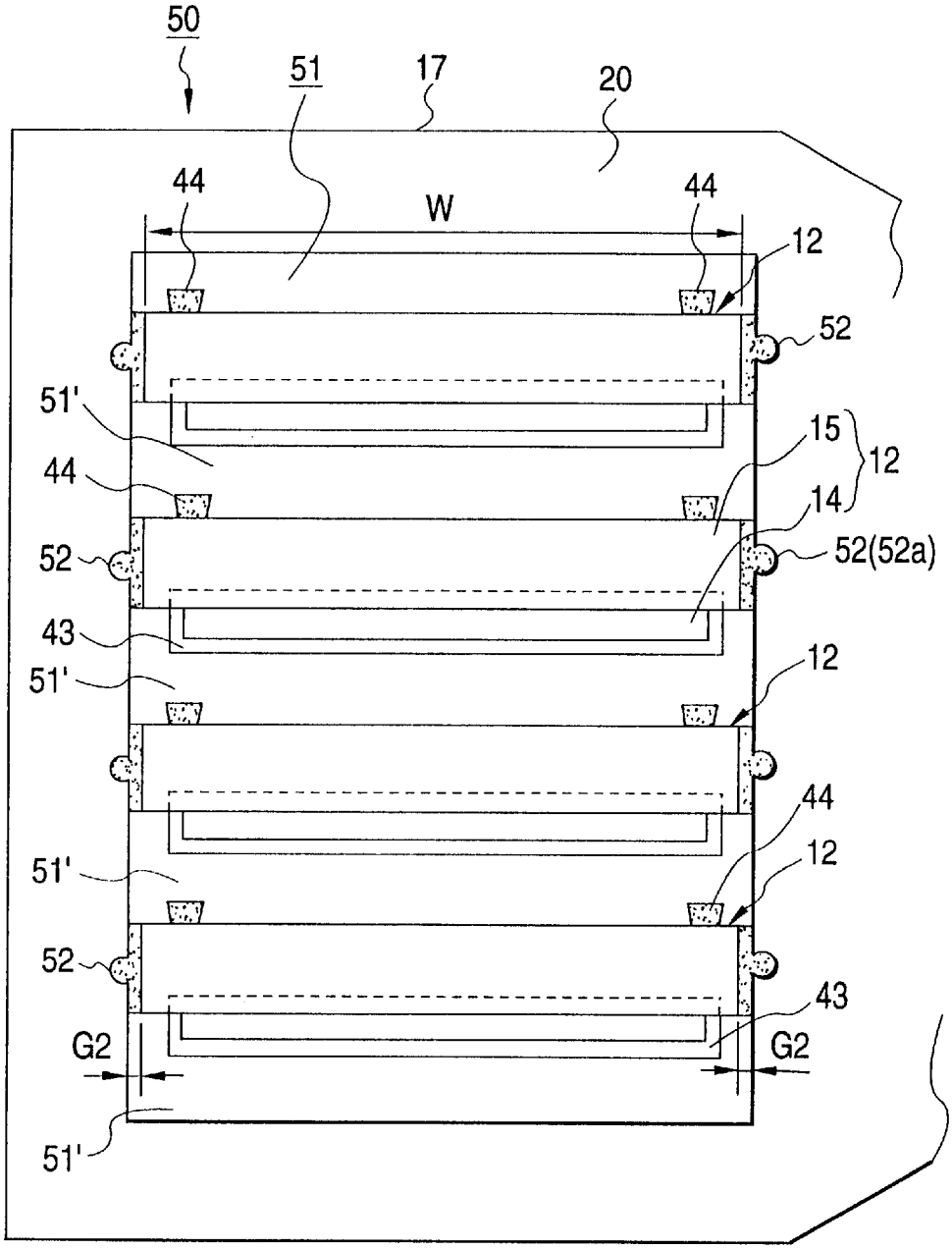
FIG. 8A is a view illustrating a recording head according to a second embodiment of the invention, viewed from the casing side.

As shown in FIG. 8A, a housing space 51 according to the second embodiment has a rectangular opening shape viewed from the flange portion 20 side, and has such a size that a plurality of vibrator units 12 can be accommodated. The housing space 51 penetrates through a casing 17 from a front end face to a rear end face thereof.

The vibrator units 12 are accommodated in the housing space 51 in the same attitude. In the embodiment, four vibrator units 12 are accommodated in the same attitude such that spaces between the adjacent vibrator units 12 are equal to each other.

A casing 17 is provided with a guide passage 52 for guiding an adhesive. In the guide passage 52, an adhesive injection port 52*a* is opened on the surface of the casing opposite to the bonding surface of a supporting base 13 and an adhesive guide portion 52*b* faces an opposed portion to the side face of a fixation base 15 and the internal wall of the casing 17. In the embodiment, the adhesive injection port 52*a* is an elliptical opening and the adhesive guide portion 52*b* is a slit or a small groove which faces the opposed portion. Moreover, the guide passage 52 is provided like a taper having a diameter increased from the inner side of the casing 17 toward the adhesive injection port 52*a*. A plurality of guide passages 52 are provided corresponding to each side face of the fixation base 15.

Referring to the vibrator unit 12, a width W of a fixation base 15 is set to be slightly smaller than the opening width of the housing space 51. For this reason, when the vibrator unit 12 is provided in a predetermined position, a very small gap G2 is formed between the side face of the fixation base 15 and the inner wall face of the casing 17.

Accordingly, the adhesive guide portion 52*b* of the guide passage 52 faces the gap G2. Moreover, the gap G2 is set to have such a width that a fluid adhesive can be held, for example, a width of approximately 50 to 300 $\mu$m. Therefore, the adhesive injected into the guide passage 52 flows from the adhesive guide portion 52*b* into the gap G2 and is held therein. By the adhesive held in the gap G2, the side face of the fixation base 15 and the inner wall face of the casing 17 are bonded to each other. The bonding will be described below.

Figure 9A:
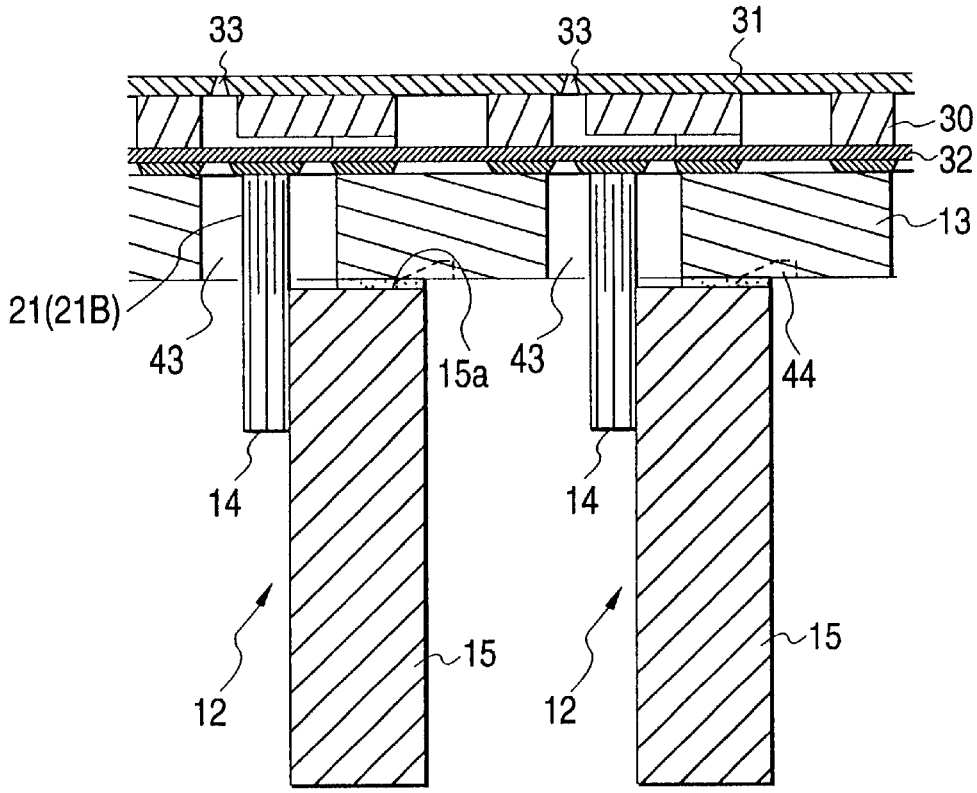
FIG. 9A is a view illustrating a vibrator unit accommodated in a casing of the recording head of the second embodiment.
Figure 9B:
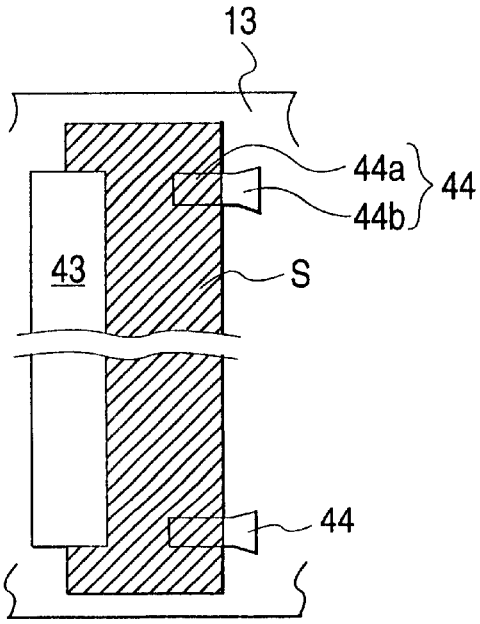
FIG. 9B is an enlarged view showing a part of a supporting base in the recording head of the second embodiment.
Figure 10:
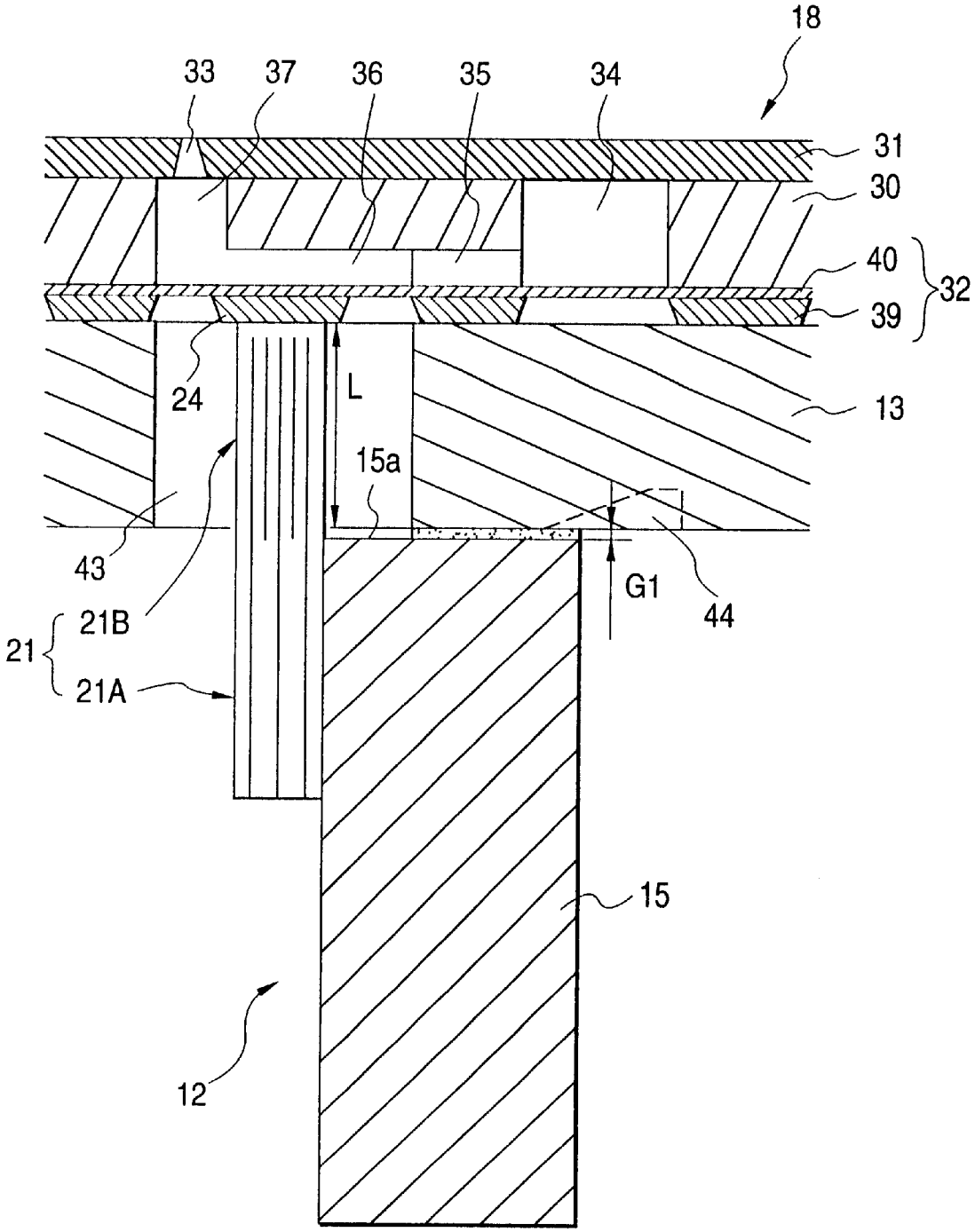
FIG. 10 is an enlarged view for FIG. 9A.

The supporting base 13 is a rectangular plate-shaped member and stainless steel is employed in the same manner as in the first embodiment. As shown in FIGS. 9A and 9B, in the supporting base 13, a plurality of through holes 43 through which free ends 21B of piezoelectric vibrators 21 are to be inserted are arranged transversely in the direction of the plate and a plurality of concave grooves 44 are provided in the vicinity of the through holes 43. Moreover, as shown in FIG. 10, the thickness of the supporting base 13 is set to be slightly smaller than a length L of the free end portion 21B of the piezoelectric vibrator 21. For this reason, when the vibrator unit 12 is arranged, a gap G1 is formed. The gap G1 in the second embodiment also has such a width that a fluid adhesive can be moved by capillary force, for example, a width of approximately 50 microns to 300 microns in the same manner as in the first embodiment.

Furthermore, a surface on the channel unit 18 side and a surface on the casing 17 side in the supporting base 13 are finished to smooth surfaces having high precision through surfacing such as lapping or polishing.

The through hole 43 and the concave groove 44 are the same as those in the first embodiment. More specifically, the through hole 43 is rectangular and takes a shape which is a size larger than the external shape of a piezoelectric vibrator group 14. The concave groove 44 serves as an adhesive reservoir for holding an adhesive or an injecting port for the adhesive. The concave groove 44 according to the embodiment also has an adhesive injection port 44*b* provided on the outside of a bonding region S and an adhesive guide portion 44*a* on the bonding region S side.

Next, the process for fabricating a recording head 50 will be described.

First of all, the channel unit 18 including the nozzle plate 31, the channel forming substrate 30 and the elastic plate 32 is laminated and integrated. Next, the support plate 15 is removed through etching to leave the elastic film 40 in a portion corresponding to the common ink reservoir 34 in the elastic plate 32 and a portion around the island portion 24. Then, the supporting base 13 finished with high surface precision is laminated and bonded onto the surface of the channel unit 18 on the elastic plate 32 side. At this time, the supporting base 13 is bonded such that the concave groove 44 is positioned on an opposite surface to the channel unit 18 side (the elastic plate 32 side). When the supporting base 13 is bonded to the channel unit 18, the casing 17 is bonded to the surface of the supporting base 13, that is, a surface on the opposite side of the channel unit 18 (a surface on the concave groove 44 side). The bonding is carried out with an adhesive, for example.

When the channel unit 18 is bonded to the casing 18, the vibrator unit 12 fabricated separately is accommodated and fixed into the housing space 51 of the casing 17. In this case, the vibrator unit 12 is held by a jig and is moved, the free ends 21B of the piezoelectric vibrators 21 are inserted in to the through hole 43 and the tip end face of the free end portion 21B is caused to abut on the island portion 24 of the elastic plate 32. In the state of arrangement, the adhesive guide portion 44*a* of the concave groove 44 is covered with the front end face 15*a* of the fixation base 15.

In this state, the gap G1 is provided between the front end face 15*a* of the fixation base 15 and the surface of the supporting base 13 and the gap G2 is provide between the side face of the fixation base 15 and the inner wall face of the casing 17. Therefore, the tip end face of the piezoelectric vibrator 21 can be caused to abut on the island portion 24 in an optimum state, and furthermore, the vibrator unit 12 can be positioned with very high precision.

In the state of arrangement, the adhesive is caused to flow into the gap G1 between the front end face 15*a* of the fixation base 15 and the supporting base 13 and the gap G2 between the side face of the fixation base 15 and the inner wall face of the casing 17, thereby bonding and fixing the fixation base 15 to the supporting base 13 and the casing 17.

More specifically, referring to the gap G2, the nozzle of an adhesive injecting apparatus is caused to face the adhesive injection port 52*a* of the guide passage 52, thereby injecting the adhesive into the adhesive injection port 52*a*. For the adhesive, an adhesive having a low viscosity, for example, an epoxy based adhesive is preferably used, for example. The reason is that the gap G2 is to be reliably filled with the adhesive and strong bonding force is to be obtained after the bonding. The adhesive injected into the guide passage 52 starts to flow from the adhesive guide portion 52*b* to the gap G2. Then, the adhesive flowing from the adhesive guide portion 52*b* comes in contact with the side face of the fixation base 15 and is thus spread through a capillary action to fill in the gap G2. In this case, a space between the side face of the fixation base 15 and the inner wall face of the casing 17 (the width of the gap G2) is very small. Therefore, the adhesive flowing into the gap G2 is held by surface tension thereof without flowing out of the gap G2.

Referring to the gap G1, similarly, the nozzle of the adhesive injecting apparatus is caused to face the adhesive injection port 44*b* of the concave groove 44, thereby injecting the adhesive into the adhesive injection port 44*b*. When the concave groove 44 is filled with the injected adhesive, the adhesive is bulged like a convex by the surface tension. When the bulged adhesive comes in contact with the front end face 15*a* of the fixation base 15, the adhesive in the concave groove 44 flows into the gap G1 by capillary force to fill in the bonding region S. Thus, the adhesive injected into the concave groove 44 is guided into the gap G1 by the capillary force. Therefore, it is possible to reliably inject the adhesive into the gap G1 between the front end face 15*a* of the fixation base 15 and the surface of the supporting base 13 in which the adhesive is hard to directly inject.

In the embodiment, furthermore, the adhesive is injected from the adhesive injection port 52*a* of the guide passage 52 and the adhesive injection port 44*b* of the concave groove 44. Therefore, the injecting work can be carried out easily. Moreover, the guide passage 52 has such a tapered shape as to have a diameter increased gradually toward the adhesive injection port 52*a*. Therefore, the opening diameter of the adhesive injection port 52*a* can be set to be great and the nozzle of the adhesive injecting apparatus can be caused to easily face the adhesive injection port 52*a*. Similarly, the width of the adhesive injection port 44*b* of the concave groove 44 is gradually increased when it goes away from the bonding region S. Therefore, the nozzle of the adhesive injecting apparatus can be caused to easily face the adhesive injection port 44*b* and the injected adhesive spills out of the concave groove 44 with difficulty. Moreover, the depth of the adhesive injection port 44*b* of the concave groove 44 is increased when it goes away from the bonding region S. Consequently, a volume is increased. Thus, it is possible to hold a sufficient amount of the adhesive for filling in the gap.

If the gap G2 and the gap G1 are filled with the adhesive, the adhesive in the gaps G1 and G2 is solidified to bond and fix the fixation base 15 of the vibrator unit 12 to the supporting base 13 and the casing 17. At this time, the adhesive can be held in the gaps G1 and G2 by the surface tension thereof. Therefore, the adhesive can be prevented from flowing into the through hole 43 through which the piezoelectric vibrator 21 is to be inserted and from sticking to other portions. Accordingly, it is possible to reliably prevent the actuation of the piezoelectric vibrator 21 from being blocked by the extra adhesive.

As described above, moreover, the vibrator unit 12 is aligned with high precision. Therefore, it is possible to maintain the vibrator unit 12 with high positional precision also after solidifying the adhesive. Also in the embodiment, furthermore, the epoxy based adhesive is used. By raising an environmental temperature during the bonding, therefore, it is possible to promote the solidification of the adhesive, thereby carrying out the bonding in a short time.

Figure 8B:
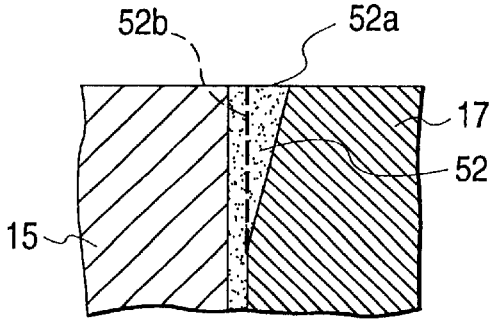
FIG. 8B is a partially enlarged sectional view illustrating an adhesive guide passage in the recording head of the second embodiment.

In the recording head 11 fabricated in the above process, as shown in FIGS. 8A, 8B and 10, the front end face 15*a* of the fixation base 15 is bonded to the surface of the supporting base 13 and the side face of the fixation base 15 is bonded to the inner wall face of the casing 17. Therefore, the fixation base 15 also serves as a bulkhead for partitioning the housing space 51 in the casing 17. More specifically, the housing space 51 in the casing 17 is partitioned into a plurality of individual housing spaces 51' through the fixation base 15 and the piezoelectric vibrator group 14 is provided in each housing space 51'.

Consequently, it is possible to eliminate a bulkhead formed of a resin which has relatedly been provided in the housing space and to efficiently accommodate a plurality of vibrator units 12 (piezoelectric vibrator group 14) in the housing space 51. Accordingly, it is possible to reduce a dimension in the direction of arrangement of the vibrator unit 12 in the recording head 11 that is, a dimension in the direction of arrangement of the piezoelectric vibrator group 14. Thus, the size of the recording head 11 can be reduced.

When the ink drop is to be discharged, the free end portion 21B of the piezoelectric vibrator 21 is extended in the longitudinal direction of the vibrator. In the operation, reaction force applied when the piezoelectric vibrator 21 pushes the island portion 24 is received by the fixation base 15 because the bulkhead formed of a resin is eliminated. Since front end face of the fixation base 15 is bonded to the supporting base 13, the reaction force applied from the piezoelectric vibrator 21 mainly acts on the supporting base 13. Moreover, since the side face of the fixation base 15 is bonded to the casing 17 and the front end face of the casing 17 is bonded to the supporting base 13, the reaction force applied from the piezoelectric vibrator 21 also acts on the supporting base 13 through the casing 17 and the fixation base 15 of the vibrator unit 12 provided in the vicinity thereof.

Since stainless steel constituting the supporting base 13 and the fixation base 15 has a higher rigidity than that of a resin constituting the casing 17, the rigidity of the recording head 11 can be increased and the reaction force can sufficiently be received from the piezoelectric vibrator 21. Furthermore, a Young's modulus of the stainless steel is approximately ten times as high as that of the resin constituting the casing 17. Therefore, even if the number of the piezoelectric vibrators 21 constituting the vibrator unit 12 is increased, the reaction force applied from the piezoelectric vibrator 21 can be received sufficiently and the discharge of the ink drop can be stabilized.

In the embodiment, moreover, the supporting base 13 and the fixation base 15 are formed of the same material, that is, stainless steel. As described above, therefore, coefficients of linear expansion of the supporting base 13 and the fixation base 15 can be adjusted to each other. Since the coefficient of linear expansion of the stainless steel is close to that of each member constituting the channel unit 18, deformation is caused by a change in a temperature with difficulty. Consequently, a shift of the piezoelectric vibrator 21 and the channel unit 18 (the island portion 24 of the elastic plate 32) can be prevented after the bonding. Moreover, the metallic steel such as stainless steel is not swollen with a high humidity. Also in this respect, the vibrator unit 12 can be assembled with high positional precision.

Furthermore, since both the supporting base 13 and the fixation base 15 are constituted by a metal material having a good thermal conductivity, the heat of the piezoelectric vibrator 21 can be efficiently discharged through the fixation base 15 and the supporting base 13. Consequently, it is also possible to prevent the temperature of the piezoelectric vibrator 21 from being raised excessively.

Next, modified examples of the second embodiment will be described below.

Figure 11A:
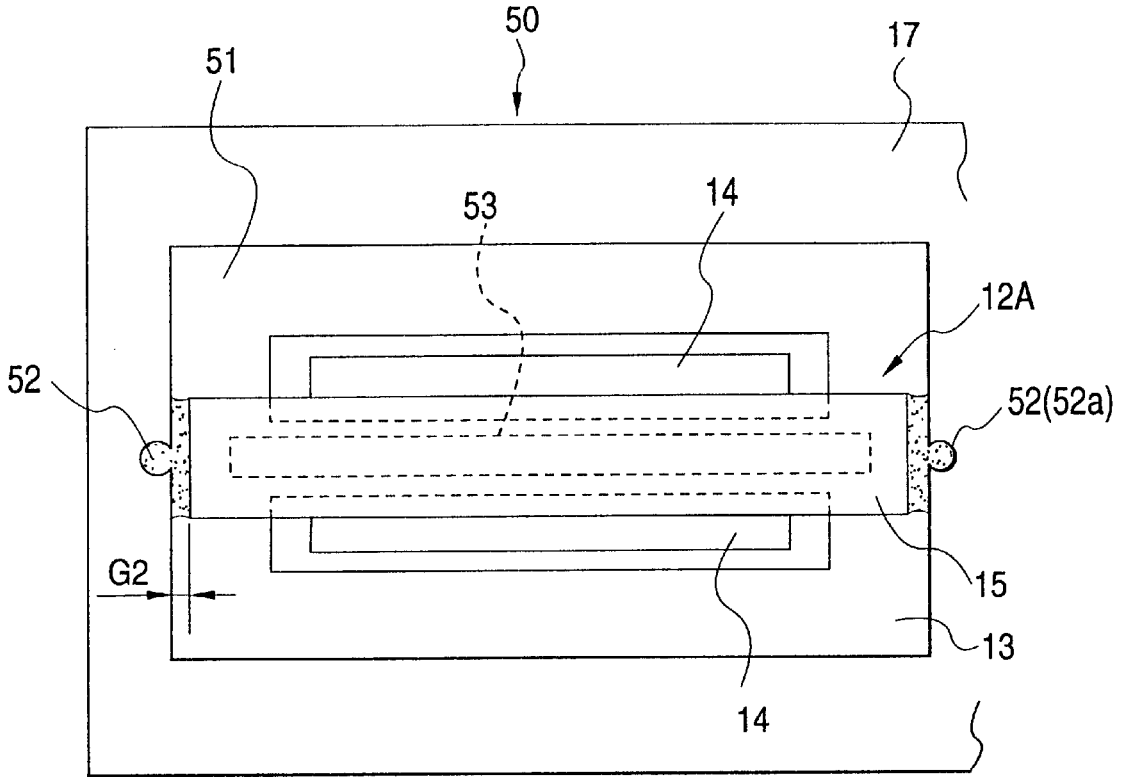
FIG. 11A is a view illustrating a first modified example of the second embodiment, viewed from the casing side.

A first modified example shown in FIG. 11A is characterized in that a vibrator unit 12A having two piezoelectric vibrator groups 14 provided back to back with respect to one fixation base 15 is used. More specifically, in such a structure that a front end face 15*a* of the fixation base 15 is bonded to a supporting base 13 and the piezoelectric vibrator groups 14 can be bonded to one of the surfaces of the fixation base 15 and the other surface thereof, respectively. The vibrator unit 12A having such a structure is accommodated and fixed into the casing 17 so that the piezoelectric vibrator groups 14 can be provided more efficiently and the size of a recording head 11 can further be reduced.

Figure 11B:
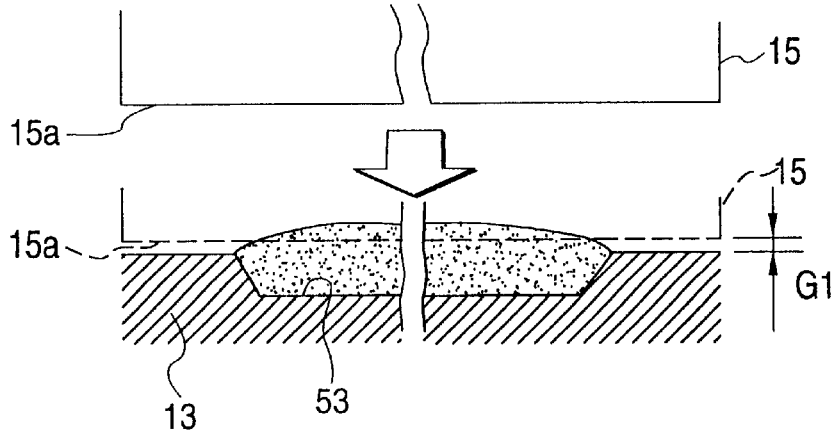
FIG. 11B is a partially enlarged view illustrating the bond of a top face of a fixation base in FIG. 11A.

As shown in FIG. 11B in this example, a concave groove 53 is fabricated to have such a shape as to be covered with the front end face 15*a* of the fixation base 15. For this reason, when the vibrator unit 12 is to be fixed, an adhesive is injected in the concave groove 53 to be bulged like a -convex from the surface of the supporting base 13 by surface tension thereof, and the vibrator unit 12 is accommodated in a housing space 51 such that the tip end face is very close to the concave groove 53. Consequently, when the front end face 15*a* of the fixation base 15 comes in contact with the adhesive, the movement of the adhesive is generated by a capillary action so that the adhesive can be caused to flow into a gap G1.

Also in this case, the adhesive is held in the concave groove 53. Therefore, it is possible to reliably carry out the bonding without causing a shortage of the adhesive. Moreover, it is also possible to prevent the adhesive from sticking to an undesired place.

Figure 12:
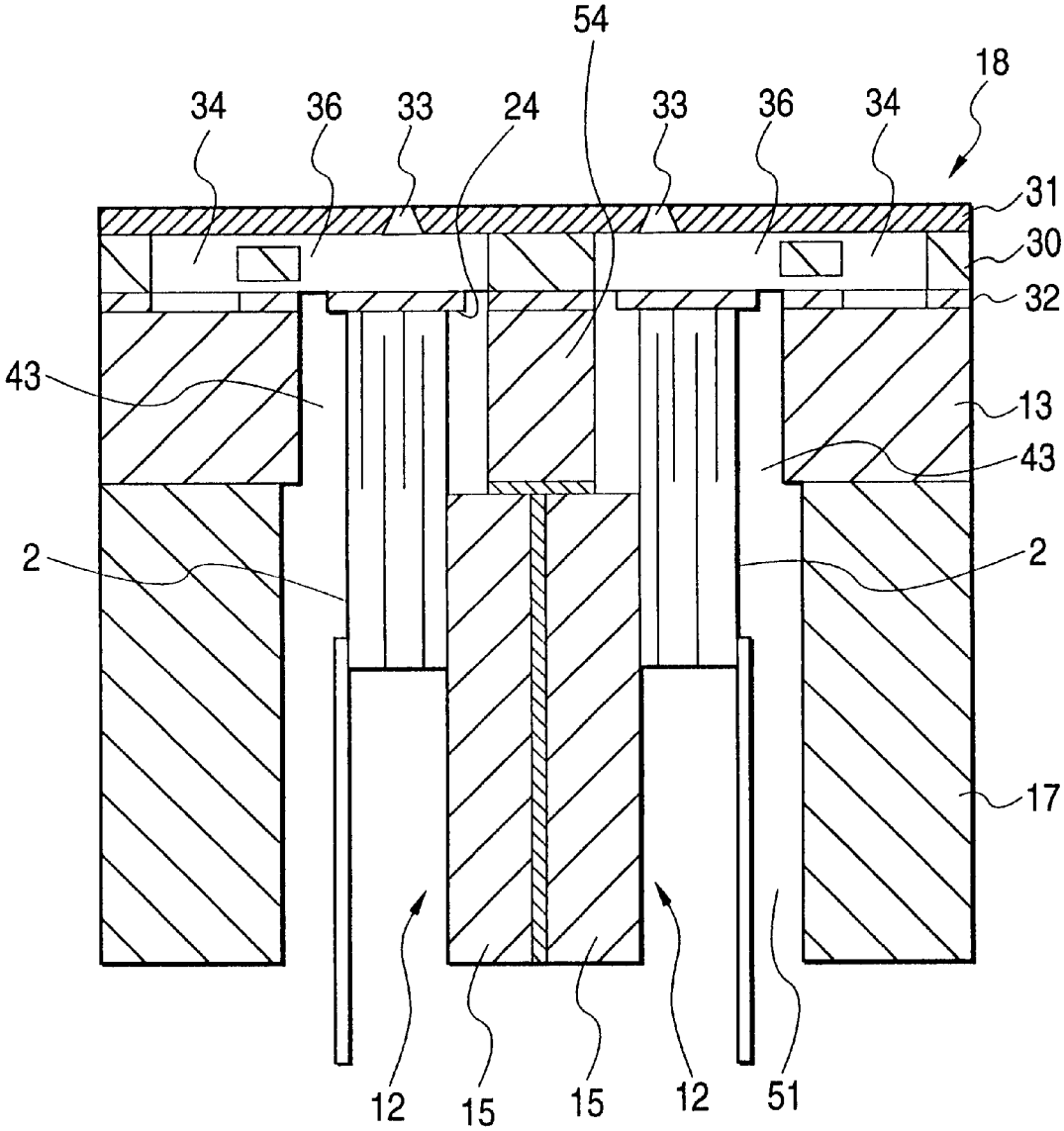
FIG. 12 is a view illustrating a second modified example of the second embodiment.

A second modified example shown in FIG. 12 is characterized in that a pair of vibrator units 12 in which a piezoelectric vibrator group 14 is bonded to one of the surfaces of a fixation base 15 are prepared and are bonded to a supporting base 13 such that back faces of the fixation bases 15 are opposed to each other.

A recording head 11 according to the second modified example is fabricated in the following process. First of all, a pair of vibrator units 12 are prepared and an adhesive is applied to the back face of the fixation base 15 in one of the vibrator units 12 (that is, a surface on the opposite side of the bonding face of the piezoelectric vibrator group 14). Then, the vibrator unit 12 and the other vibrator unit 12 are bonded with the back faces of the fixation bases 15 opposed to each other. When the vibrator units 12 are bonded to each other, an adhesive is applied to the surface of a partition 54 formed between through holes 43 of the supporting base 13, more specifically, a surface on the opposite side of a channel unit 18. Then, the front end face 15*a* of the fixation base 15 in each of the vibrator units 12 is caused to abut on the surface of the partition 54, thereby bonding the fixation base 15 to the supporting base 13.

In the second modified example, the bulkhead is not provided between both fixation bases 15. Therefore, it is possible to cause the vibrator units 12 to be influenced by deformation due to the moisture absorption of a casing 17 with difficulty. For this reason, it is possible to eliminate a drawback such as the inclination of a piezoelectric vibrator 21 and to enhance connecting reliability between the piezoelectric vibrator 21 and the island portion 24 (elastic plate 32). Moreover, since the bulkhead is not present, a space between adjacent nozzles can be reduced correspondingly. Furthermore, since the vibrator unit 12 to be used has such a structure that the piezoelectric group 14 is bonded to one of the surfaces of the fixation base 15, it can easily carry out comb-toothing and can readily be assembled into the casing 17.

All of the first embodiment and the modified example thereof and the second embodiment and the modified example thereof have such a structure that the supporting base is provided between the casing and the channel unit and the vibrator unit is bonded to the supporting base. However, the invention is not restricted to such a structure. For example, the vibrator unit may be held by the casing. In the following, a third embodiment having such a structure will be described.

Figure 13:
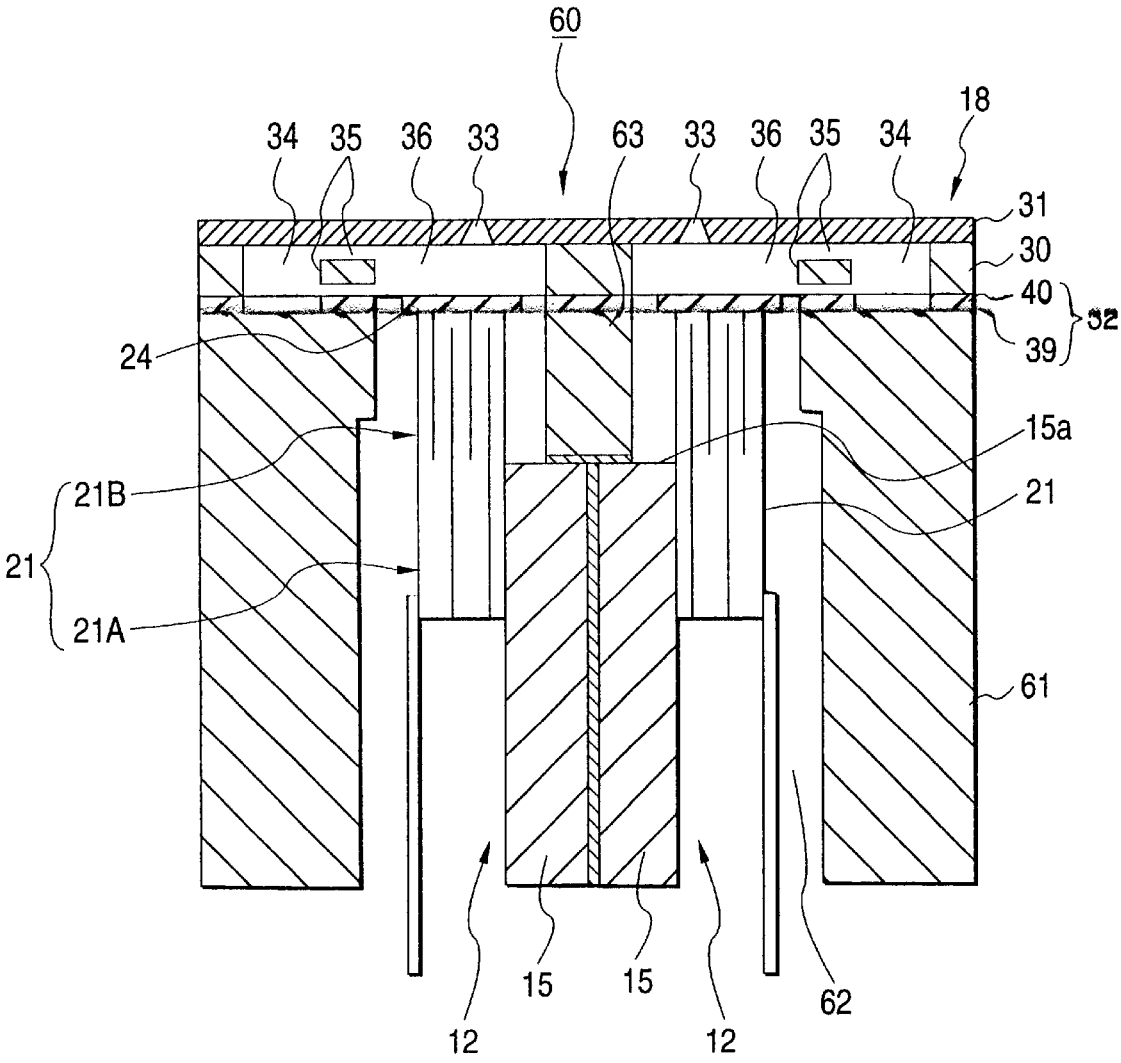
FIG. 13 is a sectional view showing an ink jet recording head according to a third embodiment of the invention.

FIG. 13 is a sectional view illustrating a recording head 60 according to the third embodiment.

The recording head 60 is identical to the recording head 11 using a piezoelectric vibrator 21 in a longitudinal vibration mode, and comprises a channel unit 18 provided with a nozzle orifice 33 and a pressure chamber 36, a casing 61 to which the channel unit 18 is bonded and in which the piezoelectric vibrator 21 is accommodated, and a pair of vibrator units 12 accommodated and held in a housing space 62 of the casing 61.

The channel unit 18 is constituted by laminating a nozzle plate 31, a channel forming substrate 30 and an elastic plate 32.

The nozzle plate 31 is a thin plate formed of stainless steel in which a plurality of nozzle orifices 33 are linearly arranged at a pitch corresponding to a dot formation density. In the embodiment, for example, 96 nozzle orifices 33 are provided at a pitch of 180 dpi to form nozzle rows.

The channel forming substrate 30 is provided with a space corresponding to a pressure chamber 36, an ink supply port 35 for supplying an ink to each pressure chamber 36 and a common ink reservoir 34 for storing an ink supplied to each pressure chamber 36. For a material constituting the channel forming substrate 30, a silicon wafer is mainly used and is not restricted, and various materials such as stainless steel or ceramics can be used.

The elastic plate 32 is a complex plate member having a double structure in which an elastic film 40 is laminated on a support plate 39 formed of stainless steel. The elastic plate seals the opening face of the space to be the pressure chamber 36, thereby constituting a part of the pressure chamber 36. More specifically, the elastic plate 32 serves as a diaphragm portion. Moreover, since elastic plate 32 seals the opening face of the space to be the common ink reservoir 34, the same part also serves as a compliance portion.

The casing 61 is formed of a synthetic resin such as epoxy and a housing space 62 having such a size as to accommodate a pair of vibrator units 12 therein is formed. The housing space 62 is serially formed from a front end face to which the channel unit 18 is to be bonded to a rear end on the opposite side. A partition 63 is formed integrally with the casing 61 in the front side portion of the housing space 62*a* so that this portion is partitioned into two spaces. Free ends 21B of the piezoelectric vibrator groups 14 are inserted through each partitioned space.

Figure 14:
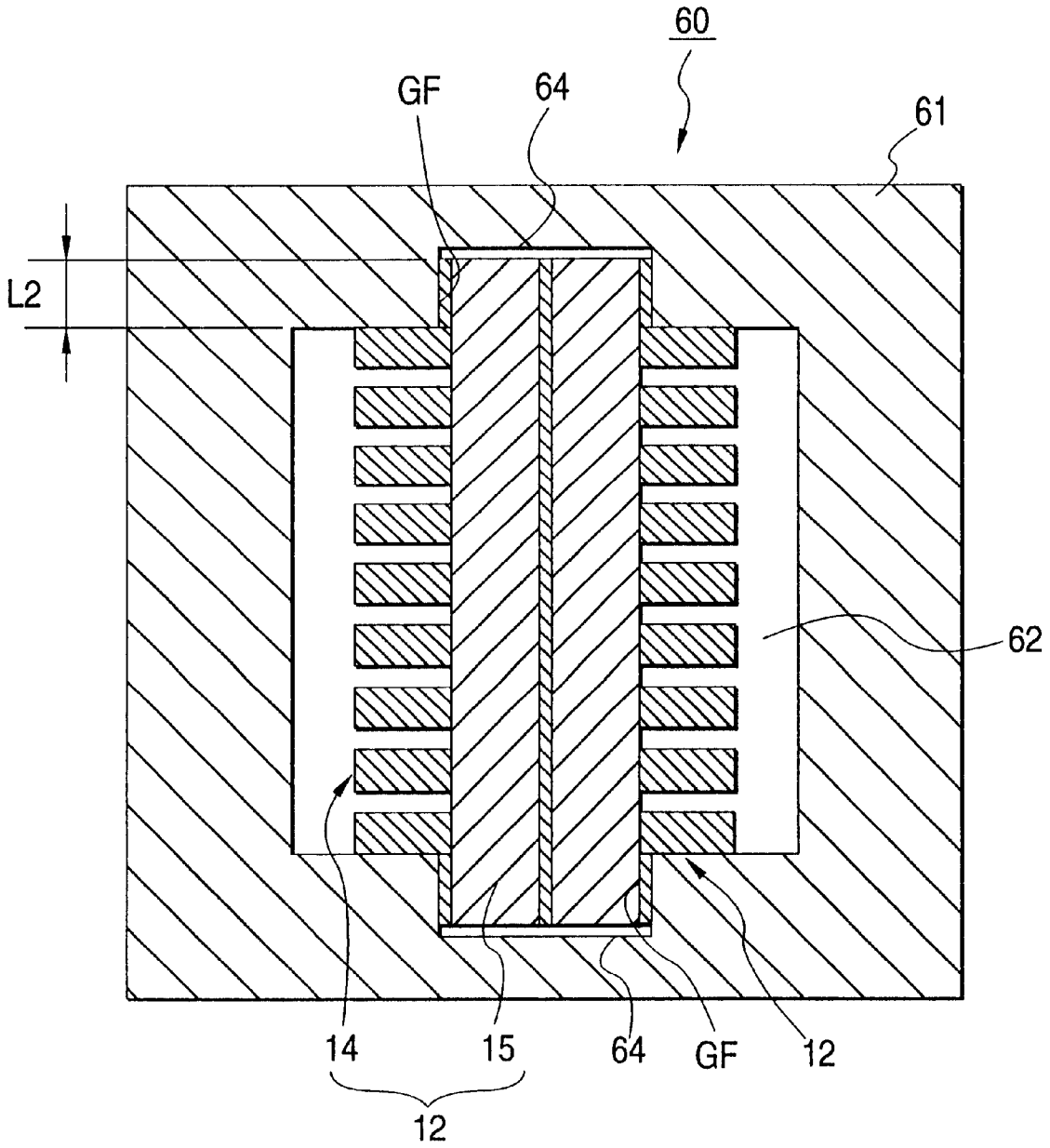
FIG. 14 is a sectional view illustrating the ink jet recording head of the third embodiment.

As shown in FIG. 14, moreover, holding grooves 64 for holding a fixation base 15 are formed on both side faces in the direction of arrangement of the vibrators in the housing space 62. The holding groove 64 is serially formed in almost the center of both side faces of the housing space so as to extend from the rear end face of the casing 61 to the level at which the partition 63 is provided. Moreover, the holding groove 64 has a width slightly greater than the thickness of the two fixation bases which are superposed and a depth slightly greater than a length L2 from the piezoelectric vibrator 21 on the end in the direction of arrangement to the side face of the fixation base 15.

For this reason, the two fixation bases 15 in the superposition state are exactly fitted in the holding groove 64, and both inner faces of the holding groove 64 serve as guide faces GF for guiding both side portions of the bonding face of the piezoelectric vibrator 21 in both fixation bases 15. In the case in which the bonded vibrator units 12 is to be inserted in the housing space 62, it is preferable that the bonded vibrator units 12 should be inserted in the housing space 62 while the fixation bases 15 are slid along the guide faces GF. Since the guide faces GF for guiding the fixation bases 15 of the bonded vibrator units 12 are provided, an assembling property can be enhanced and a working efficiency can be increased.

The surfaces of both fixation bases 15 and the guide faces GF are bonded to each other through a bonding layer.

The vibrator units 12 protrude the free ends 21B outward from the front end face 15*a* of the fixation base 15 by bonding base end portions 21A of the piezoelectric vibrators 21 to one of the surfaces of the fixation base 15. More specifically, the piezoelectric vibrators 21 constituting the piezoelectric vibrator group 14 are supported on the fixation base 15 in a cantilevered manner. The piezoelectric vibrators 21 are arranged with a space corresponding to the pressure chambers 36. The vibrator unit 12 has such a structure that the tip end faces of the piezoelectric vibrators 21 are bonded to the island portions 24 of the elastic plate 32 with the back faces of the fixation bases 15 opposed to each other.

The fixation bases 15 of the vibrator units 12 are bonded to each other through a bonding layer. More specifically, the vibrator units 12 are bonded back to back with each other. Moreover, the front end face 15*a* of the fixation base 12 is bonded to a rear end face of the partition 63 through a bonding layer. Consequently, the rigidity of the recording head 60 can be enhanced. Furthermore, the fixation base 15 and the partition 63 of the casing 61 are bonded to each other through a bonding layer. Therefore, the channel unit 18 can be prevented from being deformed due to the extension of the piezoelectric vibrator 21 and a crosstalk can be prevented from being generated.

It is preferable that a material having an almost equal coefficient of linear expansion to that of the channel forming substrate 30 should be used for the material constituting the fixation base 15. More specifically, examples include stainless steel, ceramics and a piezoelectric material. By using these materials for the fixation base 15, the coefficients of linear expansion of the fixation base 15 and the channel forming substrate 30 are adjusted and are substantially equal to each other even if an environmental temperature is changed around the recording head. Therefore, the generation of a distortion can be minimized and the discharge characteristic can be stabilized. Moreover, it is also possible to,prevent the tip end face of the piezoelectric vibrator 21 from being peeled from the island portion 24.

Moreover, it is preferable that an acoustic impedance o the fixation base 15 should be set to be higher than that of the piezoelectric vibrator 21. For this reason, it is preferable that a Young's modulus of the fixation base 15 should be set to be greater than that of the piezoelectric vibrator 21, or the density of the fixation base 15 should be higher than that of the piezoelectric vibrator 21. With such a structure, recording head components such as the casing 61 are influenced by the vibration of the piezoelectric vibrator 21 with difficulty.

In the recording head 60 having such a structure, both fixation bases 15 are directly bonded to each other. Therefore, a bulkhead is not present between the fixation bases 15. Consequently, it is possible to eliminate a drawback caused by the expansion of the bulkhead, for example, to prevent the piezoelectric vibrator 21 from being peeled from the island portion 24 and to prevent a change in the discharge characteristic. Moreover, since the bulkhead is not present, the nozzle lines can be arranged close to each other correspondingly so that the size of the recording head 60 can be reduced. Furthermore, a pair of vibrator units 12 in which the piezoelectric vibrator group 14 is bonded to one side face of the fixation base 15 is used. Therefore, the comb-toothing process of the piezoelectric vibrator 21 can be carried out for each of the vibrator units 12. Thus, the process can easily be performed.

Next, the process for fabricating the recording head 60 will be described. The recording head 60 having the above structure is generally assembled in the following order. First of all, the channel unit 18 comprising the nozzle plate 31, the channel forming substrate 30 and the elastic plate 32 is laminated and integrated. Next, a portion to serve as the compliance portion of the elastic plate 32, that is, a portion corresponding to the common ink reservoir 34 and the stainless steel in the annular portion provided around the island 24 are removed by etching, thereby causing only the elastic film 40 to remain. Then, the casing 61 is bonded to the surface on the elastic plate 32 side in the channel unit 18.

When the channel unit 18 is bonded to the casing 61, the vibrator unit 12 is bonded to the casing 61. In this case, first of all, two vibrator units 12 are bonded. For example, after an adhesive is applied onto the whole back face of the fixation base 15 in one of the vibrator units 12, the back face of the fixation base 15 in the vibrator unit 12 is bonded thereto. When the vibrator units 12 are bonded to each other, the bonding member is inserted into the housing space 62. After the adhesive is applied to the rear end face of the partition 63 and the guide face GF, the bonding member of the vibrator units 12 is inserted in the housing space 62. When the bonded assembly of the vibrator units 12 is to be inserted, the surfaces of the fixation bases 15 are guided by the guide face GF as described above so that the bonded assembly of the vibrator units 12 can easily be positioned in a predetermined position.

When the bonded assembly of the vibrator units 12 is inserted until the front end face 15*a* of the fixation base 15 abuts on the rear end face of the partition 63, the bonding member is finally positioned by fine adjustment. The positioning work is carried out before an adhesive layer for bonding the fixation bases 15 to each other and an adhesive layer for bonding the fixation base 15 to the partition 63 are completely solidified. More specifically, the positioning is carried out before the adhesive layers are solidified, the positions of the vibrator units 12 can be slightly adjusted independently. Therefore, the piezoelectric vibrators 21 can be reliably bonded to the corresponding island portions 24. When the final positioning is completed, the adhesive layer is solidified.

Figure 15:
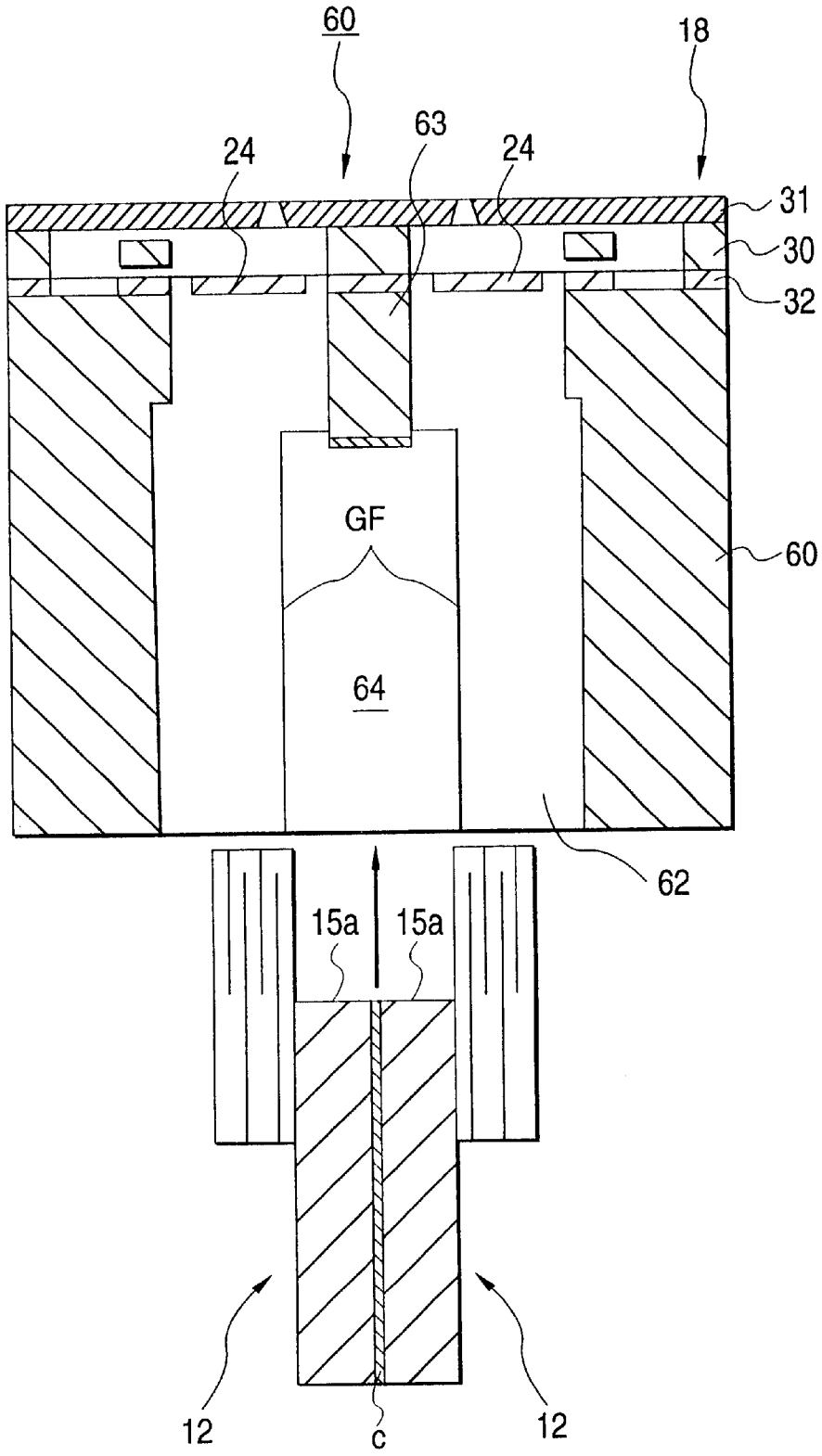
FIG. 15 is a view illustrating another example of the process for fabricating the ink jet recording head of the third embodiment.

The process for fabricating the recording head 60 is not restricted to the foregoing. For example, as shown in FIG. 15, the fixation base 15 may be slid along the guide face GF to insert the vibrator units 12 in the housing space 62 with unsolidified adhesive C held between the fixation bases 15, and subsequently, the adhesive may be injected between the guide face GF and the fixation base 15.

In such a method, the positions of the piezoelectric vibrators 21 can be slightly adjusted before the adhesive is solidified. Therefore, the piezoelectric vibrators 21 can be reliably bonded to the corresponding island portions 24.

Figure 16:
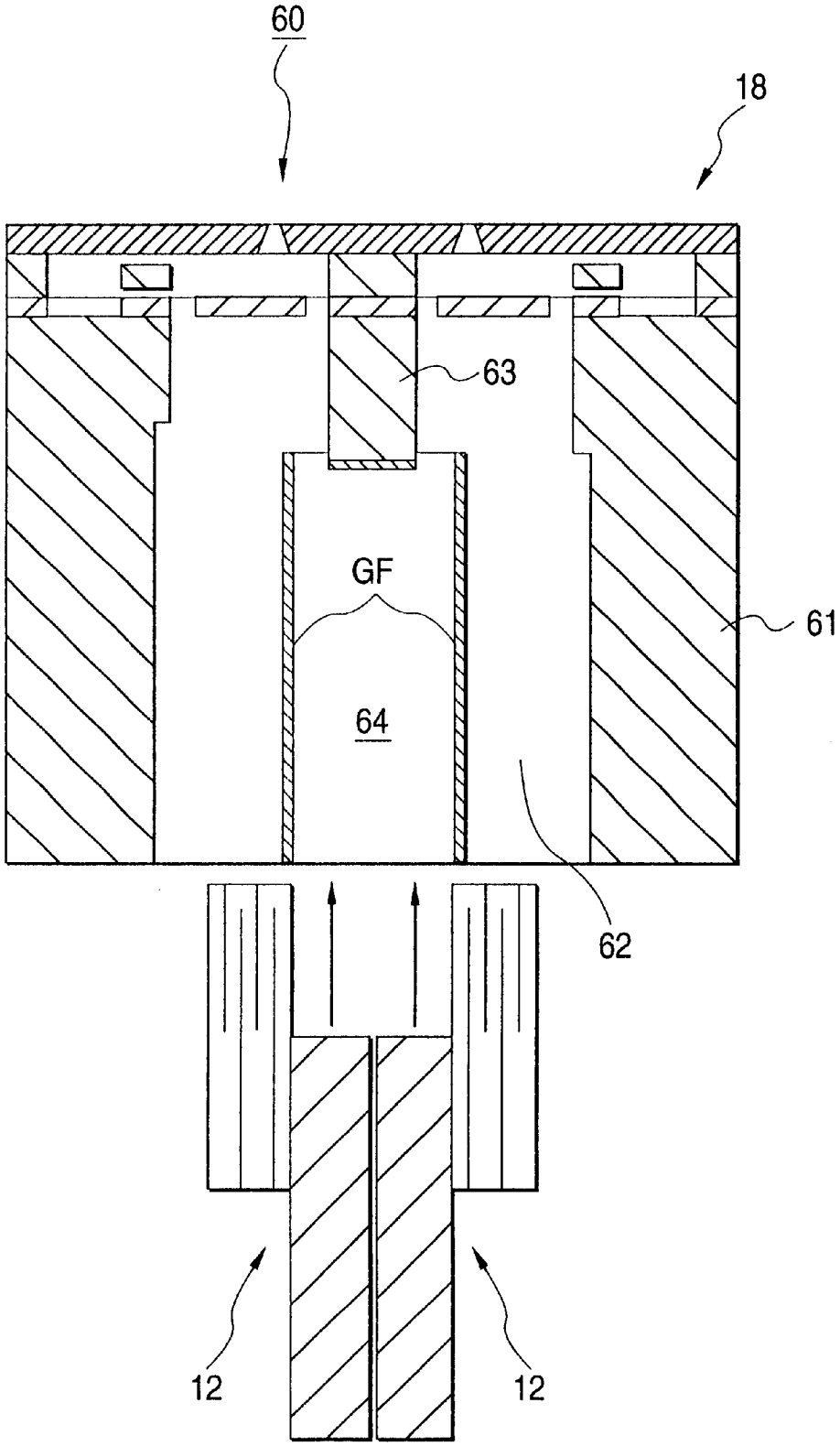
FIG. 16 is a view illustrating a further example of the process for fabricating the ink jet recording head of the third embodiment.

As shown in FIG. 16, the adhesive may be applied to the guide face GF of the casing 61 and the rear end face of the partition 63, the vibrator units 12 may be inserted in the housing space 62 before the adhesive is not solidified, and the adhesive may be injected into a clearance between the fixation bases 15 to solidify each adhesive, after the work for aligning the vibrator units 12.

Next, modified examples of the third embodiment will be described.

Figure 17:
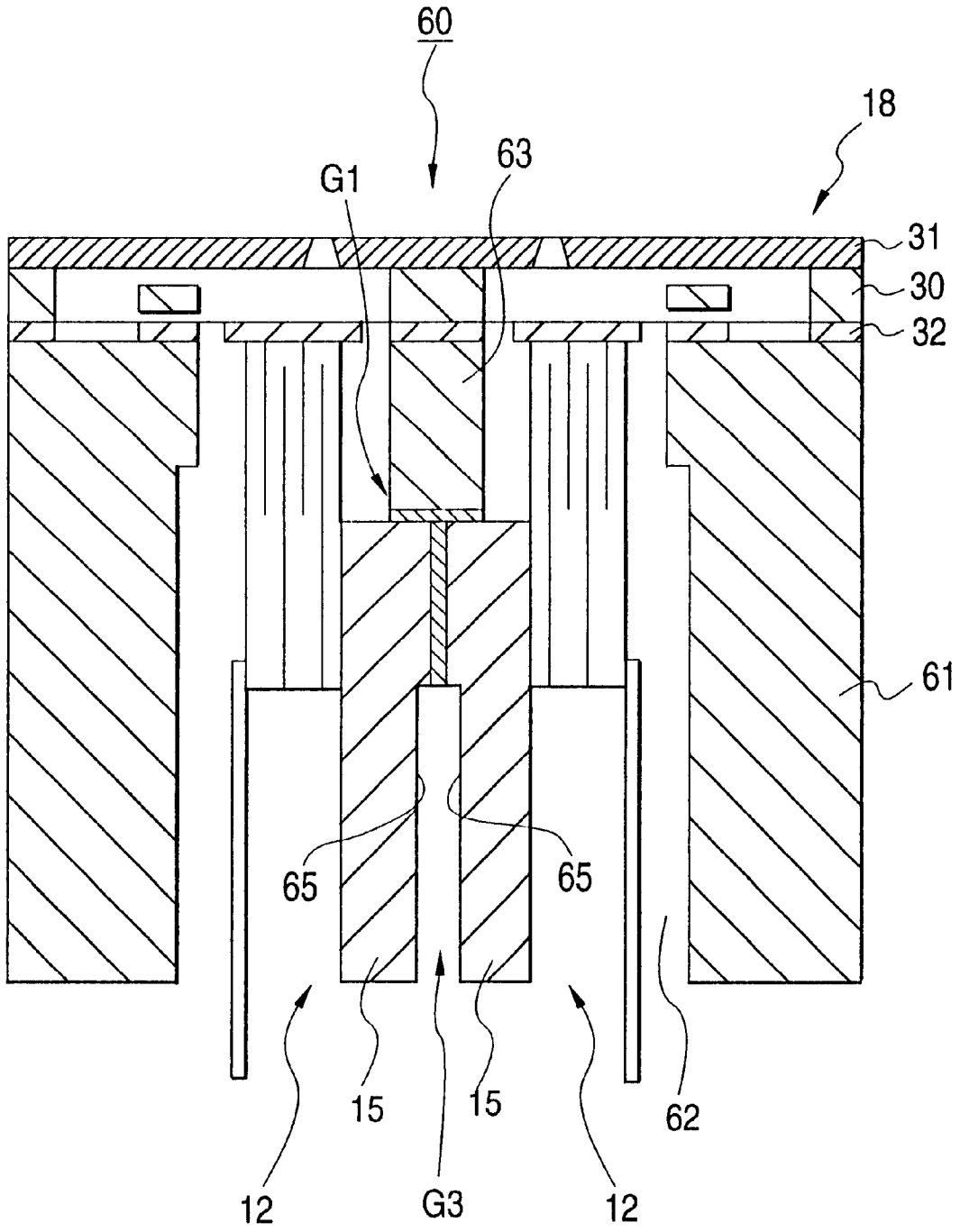
FIG. 17 is a sectional view illustrating a first modified example of the third embodiment.
Figure 18:
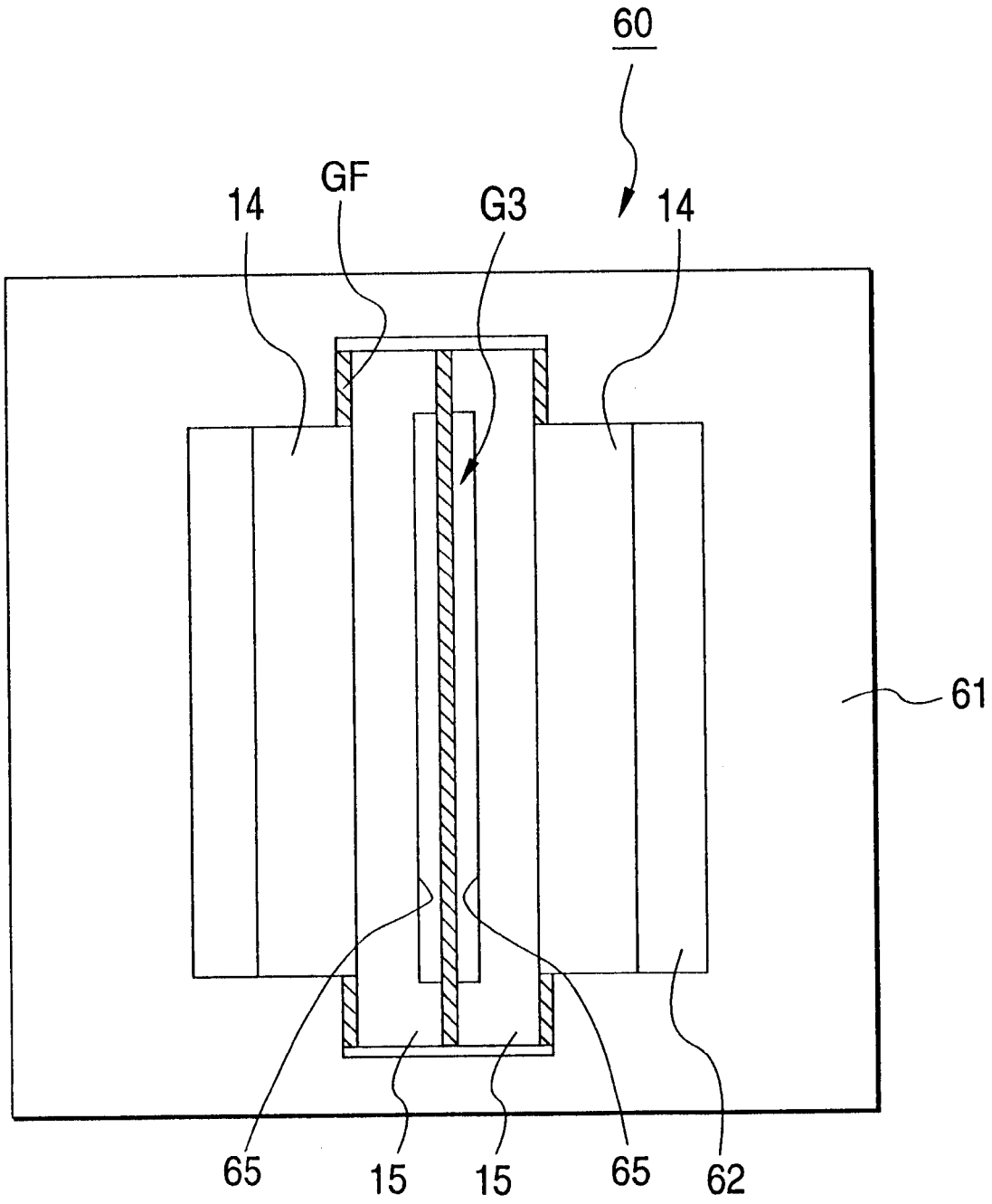
FIG. 18 is a plan view illustrating a first modified example of the third embodiment.

In a first modified example shown in FIGS. 17 and 18, an internal gap G3 formed between the fixation bases 15 has a portion corresponding to the bonding region of the piezoelectric vibrators 21 in the fixation base 15 which is narrower than other portions. The fixation bases 15 are bonded to each other with the adhesive filled in the portion on the narrow side in the internal gap G3.

In the recording head 60, moreover, notched concave portions 65 are formed in positions of the back faces of both fixation bases 15 which are opposed to each other.

More specifically, the notched concave portion 65 which is lower than the back face of the fixation base by one step is formed on the back face side of the fixation base 15, and is opened on the rear end face of the fixation base. Furthermore, the notched concave portion 65 is formed on both fixation bases 15, and the position of the notched concave portion 65 provided on one of the fixation bases 15 is aligned with the position of the notched concave portion 65 provided on the other fixation base 15.

With such a structure, a space formed by the notched concave portion 65, that is, a portion on the wide side in the internal gap G3 can be used as a space for injecting the adhesive.

More specifically, when a pair of vibrator units 12 are to be bonded into the housing space 62, it is first inserted into the housing space 62 with the back faces of the fixation bases 15 opposed to each other. Each vibrator unit 12 is positioned such that the tip end faces of the piezoelectric vibrators 21 abut on the corresponding island portions 24. When the vibrator units 12 are positioned, the nozzle of the adhesive injecting apparatus is caused to face the space formed by the notched concave portions 65, thereby injecting a predetermined amount of the adhesive. The adhesive thus injected fills in an internal gap G3 between the fixation bases 15 by a capillary action. Similarly, the adhesive fills in the gap G1 between the front end faces 15*a* of the fixation bases 15 and the rear end face of the partition 63 and a guide face gap between the guide face GF and the surface of the fixation base 15.

When each gap is filled with the adhesive, the adhesive is solidified and both vibrator units 12 are bonded into the housing space 62.

In the first modified example, thus, when the adhesive is injected into the internal gap G3 formed between the fixation bases 15, it permeates through a region having a small clearance by the capillary action and this portion is firmly bonded. Moreover, the reaction force applied when the piezoelectric vibrator 21 is extended acts on the bonding portion of the both fixation bases 15 which is close to the channel unit 18. Therefore, the fixation bases 15 are deformed with difficulty. Furthermore, the rear side portion of the internal gap G3 is enlarged by the notched concave portions 65. Therefore, the adhesive can be injected easily and the assembling property can be enhanced.

Figure 19:
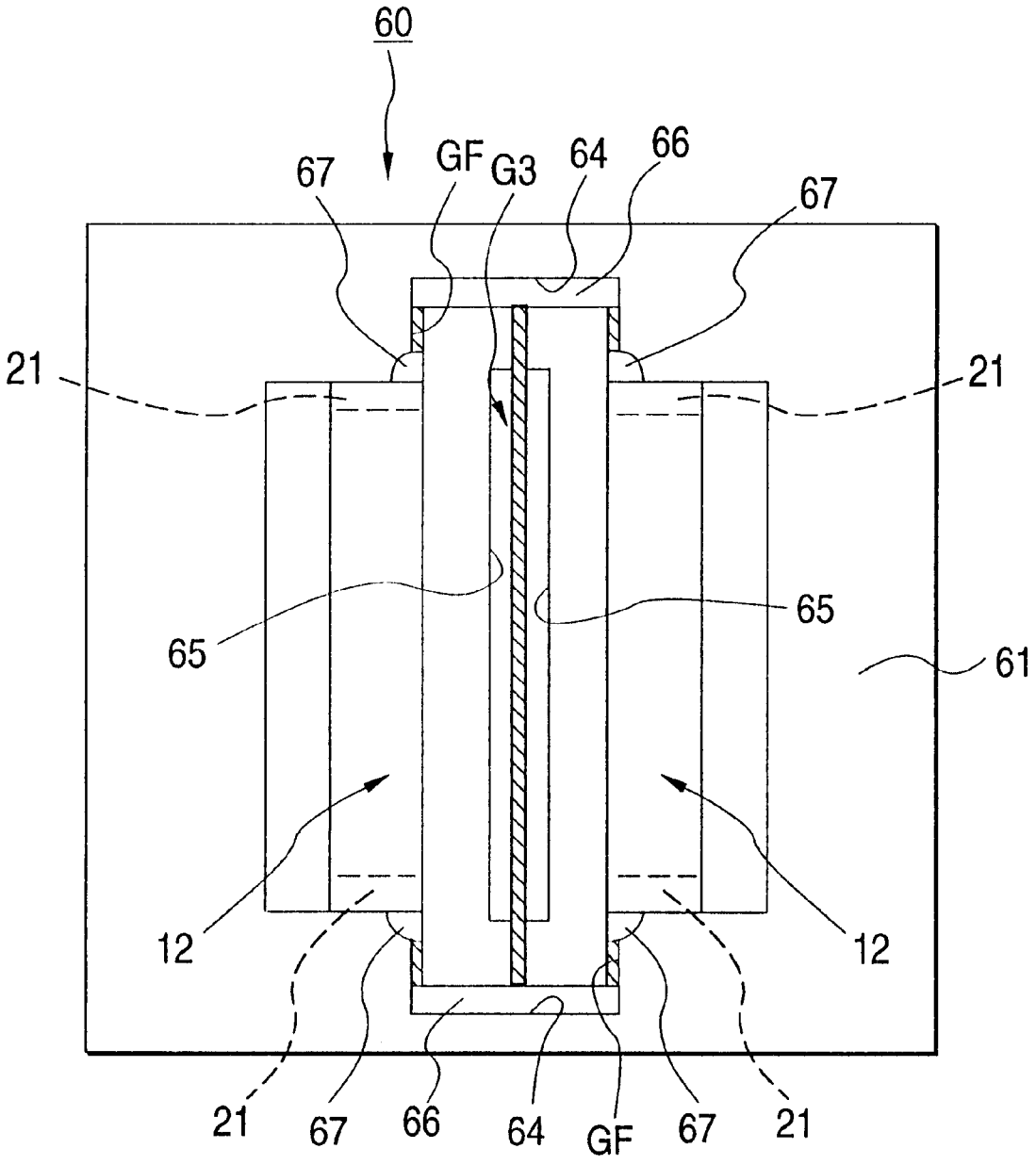
FIG. 19 is a plan view illustrating a second modified example of the third embodiment.
Figure 20:
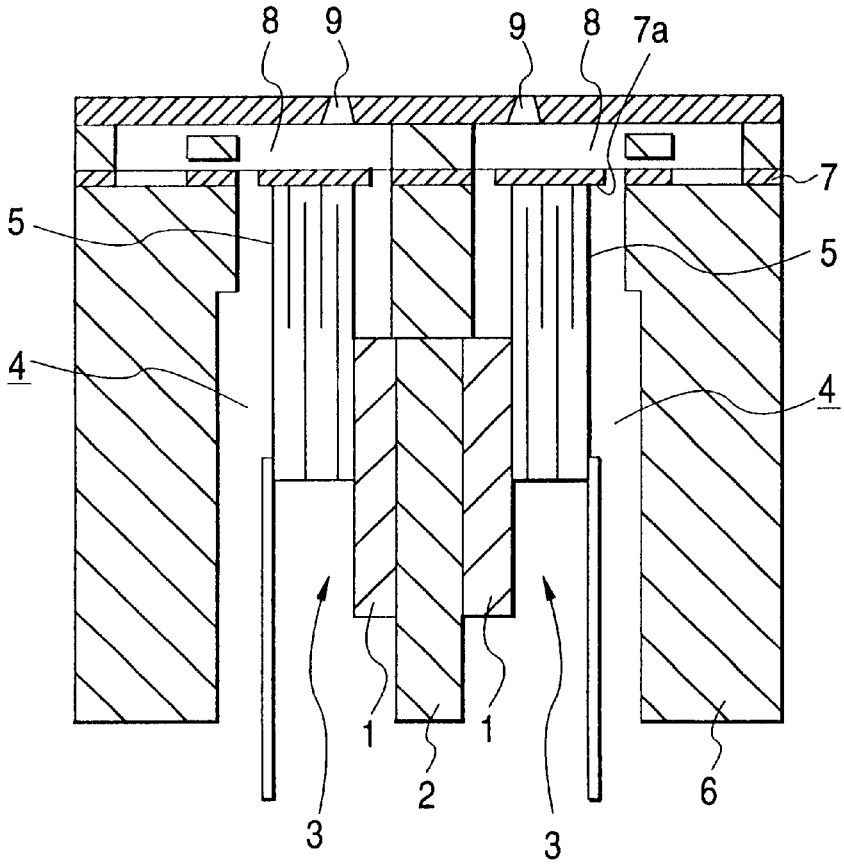
FIG. 20 is a sectional view illustrating a related ink jet recording head.
Figure 21:
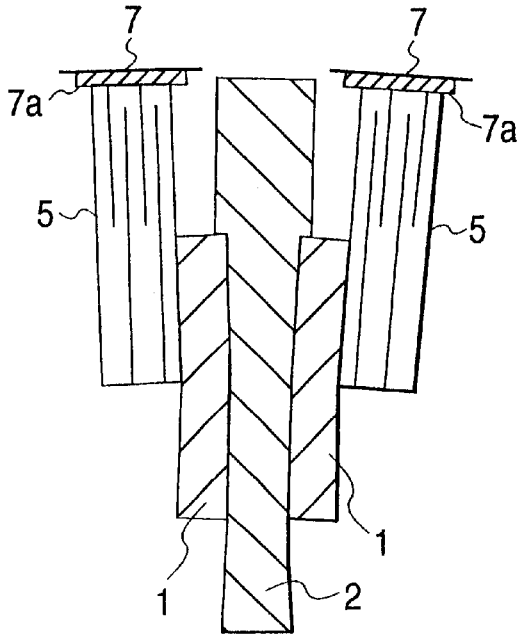
FIG. 21 is a partial sectional view illustrating the problem of the related ink jet recording head.

A second modified example shown in FIG. 19 is characterized in that a first stopper space 66 for preventing the adhesive from permeating is formed between the guide face GF and the bonding portion of the fixation bases 15, and a second stopper space 67 for preventing the adhesive from permeating is formed between the piezoelectric vibrator 21 held in the casing 61 and the guide face GF.

The first stopper space 66 is formed by separating the side face of the fixation base 15 from the opposed face of the housing space 62 (holding groove 64). More specifically, the side face of the fixation base 15 and the opposed face of the housing space 62 are separated from each other such that capillary force does not act. For this reason, the adhesive entering the gap between the guide face GF of the casing 61 and the surface of the fixation base 15 is stopped to move thereat by the surface tension. Accordingly, it is possible to prevent the adhesive from going around the side face of the fixation base 15. As a result, it is possible to prevent the bonding area of the fixation base 15 and the casing 61 from being increased excessively and to relieve a mechanical stress to be applied to the fixation base 15 which is caused by the swelling of the casing 61.

The second stopper space 67 is formed by taking away a corner portion of the guide face GF which opposes to the piezoelectric vibrator 21 positioned on the end in the direction of arrangement. Consequently, the adhesive entering the guide face gap is stopped to move thereat by the surface tension. Accordingly, the adhesive can be prevented from sticking to the piezoelectric vibrator 21 on the end.

The invention is not restricted to the above embodiments and modified examples thereof but can be variously changed based on the appended claims.

For example, the structure disclosed in one of the embodiments may be applied to the other embodiments. By way of example, the bonding assembly (see FIG. 12) of a pair of vibrator units 12 described in the second modified example of the second embodiment may be used in the first embodiment.

While the example in which the members are bonded through the adhesive has been described in each of the embodiments, it is not restricted. For example, the bonding may be carried out with an adhesive tape having an adhesive layer formed on the surface of a material. Moreover, it is preferable that the adhesive to be used in each of the embodiments should have such a viscosity as to permeate through a clearance between the members by the capillary action, which is not particularly restricted. Accordingly, it is also possible to use an adhesive other than an epoxy based adhesive.

While the piezoelectric vibrator 21 in the longitudinal vibration mode has been illustrated in each of the embodiments, a piezoelectric vibrator of a flexure vibration type may be used in place of the piezoelectric vibrator 21. The piezoelectric vibrator 21 serves to be flexed in a direction of an electric field.

While the description has been given by taking, as an example, the channel unit 18 having the channel forming substrate 30 and the nozzle plate 31 constituted by separate members in each of the embodiments, such a structure is not restricted but the channel forming substrate and the nozzle plate may be formed integrally.

What is claimed is:

1. An ink jet recording head, comprising:

a channel forming substrate, in which a channel which extends from a common ink reservoir to nozzle orifices via pressure chambers associated with the respective nozzle orifices, an elastic plate, a first surface thereof being bonded onto one surface of the channel forming substrate;

a supporting base formed with at least one through hole therein, a first face thereof being bonded onto a second surface of the elastic plate which is opposite to the first surface of the elastic plate;

a resin casing formed with an accommodation space therein, a first face thereof being bonded onto a second face of the supporting base which is opposite to the first face of the supporting base; and at least one vibrator unit, including a fixation base, and piezoelectric vibrators arranged on a first face of the fixation base such that first ends of the piezoelectric vibrators are fixed thereon and opposite free ends overhang a second face of the fixation base, the vibrator unit accommodated in the accommodation space of the casing such that the piezoelectric vibrators extend through the through hole of the supporting base and the free ends thereof abut against the second surface of the elastic plate, and such that the second face of the fixation base is bonded onto the second face of the supporting base.

2. The recording head as set forth in claim 1, wherein the supporting base is made of metal material.

3. The recording head as set forth in claim 2, wherein the supporting base is made of stainless steel.

4. The recording head as set forth in claim 1, wherein the fixation base is made of metal material.

5. The recording head as set forth in claim 4, wherein the supporting base is made of metal material identical with the metal material forming the fixation base.

6. The recording head as set forth in claim 1, wherein at least one concave groove is formed on the second face of the supporting base in the vicinity of the through hole, to hold adhesive for bonding the fixation base.

7. The recording head as set forth in claim 6, wherein there is defined a first gap between the second face of the supporting base and the second face of the fixation base, into which the adhesive held in the concave groove enters.

8. The recording head as set forth in claim 7, wherein a dimension of the first gap is so determined as to establish a capillary attraction therein.

9. The recording head as set forth in claim 6, wherein a plurality of concave grooves are formed on the fixation base.

10. The recording head as set forth in claim 9, wherein a width of the second face of the fixation base is wider than a width of an area on which the piezoelectric vibrators are arranged; and wherein the concave grooves are placed in the vicinity of both widthwise ends of the second face of the fixation base.

11. The recording head as set forth in claim 6, wherein the concave groove is formed such that a first part thereof is situated outside of a bonding area onto which the fixation base is bonded; and wherein the adhesive is injected from the first part.

12. The recording head as set forth in claim 11, wherein the first part is directed to a thickness direction of the second face of the fixation base.

13. The recording head as set forth in claim 11, wherein the first part is directed to a widthwise direction of the second face of the fixation base.

14. The recording head as set forth in claim 11, wherein a width of the first part becomes wider as being away from the bonding area.

15. The recording head as set forth in claim 6, wherein the adhesive is epoxy based adhesive.

16. The recording head as pet forth in claim 1, wherein a dimension of the through hole in a first direction in which the piezoelectric vibrators are arranged is wider than a width of the second face of the fixation base, so that both side ends of the through hole in the first direction is situated outside of an area for bonding the supporting base and the fixation base.

17. The recording head as set forth in claim 1, wherein side faces of the fixation base which are other than the first face and the second face are bonded onto an inner face of the accommodation space of the casing.

18. The recording head as set forth in claim 17, wherein there is defined a second gap between each side face of the fixation base and the inner face of the casing, to hold adhesive therein for bonding the fixation base and the casing.

19. The recording head as set forth in claim 18, wherein a dimension of the second gap is so determined as to establish a capillary attraction therein.

20. The recording head as set forth in claim 17, wherein a guide passage is formed on the inner face of the casing such that a first end thereof opens at a second face of the casing which is opposite to the first face of the casing, and such that a second end thereof is placed at an area in which the side faces of the fixation base faces the inner face of the casing; and wherein adhesive is injected from the first end of the guide passage to bond the fixation base onto the inner face of the casing.

21. The recording head as set forth in claim 20, wherein a width of the guide passage becomes wider as closing to the first end thereof.

22. The recording head as set forth in claim 1, wherein a pair of vibrator units are accommodated in the casing while third faces of the fixation bases which are opposite to the respective first faces are faced with each other.

23. The recording head as set forth in claim 1, wherein an acoustic impedance of the fixation base is greater than that of the piezoelectric vibrator.

24. The recording head as set forth in claim 23, wherein a Young's modulus of the fixation base is greater than that of the piezoelectric vibrator.

25. The recording head as set forth in claim 23, wherein a density of the fixation base is greater than that of the piezoelectric vibrator.

26. An ink jet recording head, comprising:

a channel unit including:

a channel forming substrate, in which a channel which extends from a common ink reservoir to nozzle orifices via pressure chambers associated with the respective nozzle orifices; and an elastic plate, a first surface thereof being bonded onto one surface of the channel forming substrate; and a pair of vibrator units, each including a fixation base, and piezoelectric vibrators arranged on a first face of the fixation base such that first ends of the piezoelectric vibrators are fixed thereon and opposite free ends overhang a second face of the fixation base, the vibrator units arranged such that the free ends of the piezoelectric vibrators abut against a second surface of the elastic plate which is opposite to the first surface of the elastic plate, and such that third faces of the fixation bases which are opposite to the respective first faces are faced with each other.

27. The recording head as set forth in claim 26, wherein the third faces are bonded with each other via an adhesive layer.

28. The recording head as set forth in claim 27, wherein the adhesive layer is placed so as to include a first area which is opposite to an area on which the first ends of the piezoelectric vibrators are fixed.

29. The recording head as set forth in claim 27, wherein a recessed portion is formed on the third face of the fixation base so as to open at a fourth face of the fixation base which is opposite to the second face of the fixation base.

30. The recording head as set forth in claim 29, wherein the fixation bases are integrated such that the respective recessed portions faces with each other.

31. The recording head as set forth in claim 27, wherein the adhesive is epoxy based adhesive.

32. The recording head as set forth in claim 26, wherein there is defined a first gap between the third faces of the fixation bases so as to become narrow at a first area which is opposite to an area on which the first ends of the piezoelectric vibrators are fixed.

33. The recording head as set forth in claim 26, further comprising a resin casing formed with a space for accommodating the vibrator units therein, a first face thereof being bonded onto the second surface of the elastic plate.

34. The recording head asset forth in claim 33, wherein a guide face is formed on an inner face of the casing for guiding the fixation bases when the vibrator units are accommodated in the casing.

35. The recording head as set forth in claim 34, wherein both widthwise end portions of the fixation base is guided by the guide face.

36. The recording head as set forth in claim 34, wherein the fixation base and the guide face are bonded with adhesive.

37. The recording head as set forth in claim 36, wherein the guide face and a portion of the fixation base facing the guide face are separated such an extent that the adhesive cannot enter a gap defined therebetween.

38. The recording head as set forth in claim 36, wherein a portion of the guide face which faces an outermost piezoelectric vibrator is notched such an extend that the adhesive cannot enter the notched portion.

39. The recording head as set forth in claim 33, wherein the second face of the fixation base is bonded onto the casing.

40. The recording head as set forth in claim 26, wherein a coefficient of linear expansion of the fixation base is substantially identical with that of the channel unit.

41. The recording head as set forth in claim 26, wherein the fixation base is made of at least one of stainless steel, ceramics and piezoelectric material.

* * * * *